US008085224B2

(12) United States Patent
Kanai et al.

(10) Patent No.: US 8,085,224 B2
(45) **Date of Patent: *Dec. 27, 2011**

(54) IMAGE DISPLAY APPARATUS

(75) Inventors: Izumi Kanai, Tokyo (JP); Hisanobu Azuma, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 811 days.

This patent is subject to a terminal disclaimer.

(21) Appl. No.: 12/164,476

(22) Filed: Jun. 30, 2008

(65) Prior Publication Data

US 2009/0009438 A1 Jan. 8, 2009

Related U.S. Application Data

(60) Continuation of application No. 11/370,940, filed on Mar. 9, 2006, now Pat. No. 7,432,884, which is a division of application No. 10/870,070, filed on Jun. 18, 2004, now Pat. No. 7,046,219.

(30) Foreign Application Priority Data

Jun. 20, 2003 (JP) ..... 2003-176904
Jun. 3, 2004 (JP) ..... 2004-165465

(51) Int. Cl.
*G09G 3/22* (2006.01)
*H05B 39/00* (2006.01)

(52) U.S. Cl. ..... 345/75.2; 345/690

(58) Field of Classification Search ..... 345/75, 345/75.2, 690
See application file for complete search history.

(56) References Cited

U.S. PATENT DOCUMENTS 5,525,873 A 6/1996 Lambert et al. ..... 315/366
5,734,361 A 3/1998 Suzuki et al. ..... 345/74.1
5,844,531 A 12/1998 Betsui ..... 345/74.1

(Continued)

FOREIGN PATENT DOCUMENTS

CN 1396616 A 2/2003

(Continued)

*Primary Examiner* — Amr Awad
*Assistant Examiner* — Randal Willis
(74) *Attorney, Agent, or Firm* — Fitzpatrick, Cella, Harper & Scinto

(57) ABSTRACT

An image display apparatus of this invention includes a neighborhood data integration section 20 which integrates image data on respective colors corresponding to electron emitting devices proximate to an electron emitting device to be driven, and corresponding to a phosphor contributing to a halation, an adder 6 adds the integrated image data R22, G22, and B22 on the respective colors, a coefficient operation section 7 which multiplies an addition result by a predetermined coefficient according to a luminous intensity of the halation, an adder 8 which adds outputs R23, G23, and B23 obtained by inverting a sign of multiplication results to image data R14, G14, and B14 corresponding to the electron emitting device to be driven, respectively, and a comparator 11 which compares an addition result with zero in magnitude, and which outputs a driving signal R25 for the respective colors.

18 Claims, 17 Drawing Sheets

U.S. PATENT DOCUMENTS

| | | | | |
|---|---|---|---|---|
| 6,307,327 | B1 | 10/2001 | Xie et al. | 315/169.4 |
| 6,329,759 | B1 | 12/2001 | Tanaka et al. | 315/169.3 |
| 6,580,407 | B1 | 6/2003 | Suzuki et al. | 345/74.1 |
| 6,603,450 | B1 | 8/2003 | Yamazaki et al. | 345/75.2 |
| 6,712,660 | B2 | 3/2004 | Aoki et al. | 445/3 |
| 6,842,160 | B2 | 1/2005 | Yamazaki et al. | 345/76 |
| 6,888,519 | B2 | 5/2005 | Yamano et al. | 345/75.2 |
| 6,890,229 | B2 | 5/2005 | Aoki et al. | 445/3 |
| 6,947,018 | B1 | 9/2005 | Yamazaki | 345/75.2 |
| 7,046,219 | B2 * | 5/2006 | Kanai et al. | 345/75.2 |
| 7,142,177 | B2 | 11/2006 | Kanai et al. | 345/74.1 |
| 7,199,771 | B2 | 4/2007 | Yamazaki et al. | 345/84 |
| 7,227,519 | B1 | 6/2007 | Kawase et al. | 345/77 |
| 2002/0171608 | A1 | 11/2002 | Kanai et al. | 345/55 |
| 2003/0063110 | A1 | 4/2003 | Sagano | 345/694 |
| 2003/0107542 | A1 | 6/2003 | Abe et al. | 345/89 |
| 2005/0030263 | A1 | 2/2005 | Yamazaki | 345/75.1 |

FOREIGN PATENT DOCUMENTS

| | | | |
|---|---|---|---|
| EP | 1 258 907 | A2 | 11/2002 |
| JP | 11-24629 | | 1/1999 |
| JP | 11-242457 | | 9/1999 |
| JP | 11-250839 | | 9/1999 |
| JP | 11-250840 | | 9/1999 |
| JP | 11-345561 | | 12/1999 |
| JP | 2000-3664 | | 1/2000 |
| JP | 2000-242214 | | 9/2000 |
| JP | 2003-29697 | | 1/2003 |
| JP | 2003-36049 | | 2/2003 |
| WO | WO 01/56002 | A2 | 8/2001 |

* cited by examiner a44 a11

| | | | | | | |
|---|---|---|---|---|---|---|
| 0 | 0 | 0 | 1 | 0 | 0 | 0 |
| 0 | 1 | 1 | 1 | 1 | 1 | 0 |
| 0 | 1 | 1 | 1 | 1 | 1 | 0 |
| 1 | 1 | 1 | 1 | 1 | 1 | 1 |
| 0 | 1 | 1 | 1 | 1 | 1 | 0 |
| 0 | 1 | 1 | 1 | 1 | 1 | 0 |
| 0 | 0 | 0 | 1 | 0 | 0 | 0 |

a77

FIG. 7A

| | | | | | | |
|---|---|---|---|---|---|---|
| 0 | 0 | 0 | 1 | 0 | 0 | 0 |
| 0 | 1 | 1 | 1 | 1 | 1 | 0 |
| 0 | 1 | 1 | 1 | 1 | 1 | 0 |
| 1 | 1 | 1 | 1 | 1 | 1 | 1 |
| 0 | 1 | 1 | 1 | 1 | 1 | 0 |
| 0 | 1 | 1 | 1 | 1 | 1 | 0 |
| 0 | 0 | 0 | 0 | 0 | 0 | 0 |

FIG. 7B

| | | | | | | |
|---|---|---|---|---|---|---|
| 0 | 0 | 0 | 1 | 0 | 0 | 0 |
| 0 | 1 | 1 | 1 | 1 | 1 | 0 |
| 0 | 1 | 1 | 1 | 1 | 1 | 0 |
| 1 | 1 | 1 | 1 | 1 | 1 | 1 |
| 0 | 1 | 1 | 1 | 1 | 1 | 0 |
| 0 | 0 | 0 | 0 | 0 | 0 | 0 |
| 0 | 0 | 0 | 0 | 0 | 0 | 0 |

FIG. 7C

| | | | | | | |
|---|---|---|---|---|---|---|
| 0 | 0 | 0 | 1 | 0 | 0 | 0 |
| 0 | 1 | 1 | 1 | 1 | 1 | 0 |
| 0 | 1 | 1 | 1 | 1 | 1 | 0 |
| 1 | 1 | 1 | 1 | 1 | 1 | 1 |
| 0 | 0 | 0 | 0 | 0 | 0 | 0 |
| 0 | 0 | 0 | 0 | 0 | 0 | 0 |
| 0 | 0 | 0 | 0 | 0 | 0 | 0 |

FIG. 7D

| | | | | | | |
|---|---|---|---|---|---|---|
| 0 | 0 | 0 | 0 | 0 | 0 | 0 |
| 0 | 0 | 0 | 0 | 0 | 0 | 0 |
| 0 | 0 | 0 | 0 | 0 | 0 | 0 |
| 1 | 1 | 1 | 1 | 1 | 1 | 1 |
| 0 | 1 | 1 | 1 | 1 | 1 | 0 |
| 0 | 1 | 1 | 1 | 1 | 1 | 0 |
| 0 | 0 | 0 | 1 | 0 | 0 | 0 |

FIG. 7E

| | | | | | | |
|---|---|---|---|---|---|---|
| 0 | 0 | 0 | 0 | 0 | 0 | 0 |
| 0 | 0 | 0 | 0 | 0 | 0 | 0 |
| 0 | 1 | 1 | 1 | 1 | 1 | 0 |
| 1 | 1 | 1 | 1 | 1 | 1 | 1 |
| 0 | 1 | 1 | 1 | 1 | 1 | 0 |
| 0 | 1 | 1 | 1 | 1 | 1 | 0 |
| 0 | 0 | 0 | 1 | 0 | 0 | 0 |

FIG. 7F

| | | | | | | |
|---|---|---|---|---|---|---|
| 0 | 0 | 0 | 0 | 0 | 0 | 0 |
| 0 | 1 | 1 | 1 | 1 | 1 | 0 |
| 0 | 1 | 1 | 1 | 1 | 1 | 0 |
| 1 | 1 | 1 | 1 | 1 | 1 | 1 |
| 0 | 1 | 1 | 1 | 1 | 1 | 0 |
| 0 | 1 | 1 | 1 | 1 | 1 | 0 |
| 0 | 0 | 0 | 1 | 0 | 0 | 0 |

FIG. 8A

| | | | | | | |
|---|---|---|---|---|---|---|
| 0 | 0 | 0 | 0 | 0 | 0 | 0 |
| 0 | 0 | 0 | 0 | 0 | 0 | 0 |
| 0 | 0 | 0 | 0 | 0 | 0 | 0 |
| 0 | 0 | 0 | 0 | 0 | 0 | 0 |
| 0 | 0 | 0 | 0 | 0 | 0 | 0 |
| 0 | 0 | 0 | 0 | 0 | 0 | 0 |
| 0 | 0 | 0 | 0 | 0 | 0 | 0 |

FIG. 8B

| | | | | | | |
|---|---|---|---|---|---|---|
| 0 | 0 | 0 | 0 | 0 | 0 | 0 |
| 0 | 0 | 0 | 0 | 0 | 0 | 0 |
| 0 | 0 | 0 | 0 | 0 | 0 | 0 |
| 0 | 0 | 0 | 0 | 0 | 0 | 0 |
| 0 | 0 | 0 | 0 | 0 | 0 | 0 |
| 0 | 0 | 0 | 0 | 0 | 0 | 0 |
| 0 | 0 | 0 | 1 | 0 | 0 | 0 |

FIG. 8C

| | | | | | | |
|---|---|---|---|---|---|---|
| 0 | 0 | 0 | 0 | 0 | 0 | 0 |
| 0 | 0 | 0 | 0 | 0 | 0 | 0 |
| 0 | 0 | 0 | 0 | 0 | 0 | 0 |
| 0 | 0 | 0 | 0 | 0 | 0 | 0 |
| 0 | 0 | 0 | 0 | 0 | 0 | 0 |
| 0 | 1 | 1 | 1 | 1 | 1 | 0 |
| 0 | 0 | 0 | 1 | 0 | 0 | 0 |

FIG. 8D

| | | | | | | |
|---|---|---|---|---|---|---|
| 0 | 0 | 0 | 0 | 0 | 0 | 0 |
| 0 | 0 | 0 | 0 | 0 | 0 | 0 |
| 0 | 0 | 0 | 0 | 0 | 0 | 0 |
| 0 | 0 | 0 | 0 | 0 | 0 | 0 |
| 0 | 1 | 1 | 1 | 1 | 1 | 0 |
| 0 | 1 | 1 | 1 | 1 | 1 | 0 |
| 0 | 0 | 0 | 1 | 0 | 0 | 0 |

FIG. 8E

| | | | | | | |
|---|---|---|---|---|---|---|
| 0 | 0 | 0 | 1 | 0 | 0 | 0 |
| 0 | 1 | 1 | 1 | 1 | 1 | 0 |
| 0 | 1 | 1 | 1 | 1 | 1 | 0 |
| 0 | 0 | 0 | 0 | 0 | 0 | 0 |
| 0 | 0 | 0 | 0 | 0 | 0 | 0 |
| 0 | 0 | 0 | 0 | 0 | 0 | 0 |
| 0 | 0 | 0 | 0 | 0 | 0 | 0 |

FIG. 8F

| | | | | | | |
|---|---|---|---|---|---|---|
| 0 | 0 | 0 | 1 | 0 | 0 | 0 |
| 0 | 1 | 1 | 1 | 1 | 1 | 0 |
| 0 | 0 | 0 | 0 | 0 | 0 | 0 |
| 0 | 0 | 0 | 0 | 0 | 0 | 0 |
| 0 | 0 | 0 | 0 | 0 | 0 | 0 |
| 0 | 0 | 0 | 0 | 0 | 0 | 0 |
| 0 | 0 | 0 | 0 | 0 | 0 | 0 |

FIG. 8G

| | | | | | | |
|---|---|---|---|---|---|---|
| 0 | 0 | 0 | 1 | 0 | 0 | 0 |
| 0 | 0 | 0 | 0 | 0 | 0 | 0 |
| 0 | 0 | 0 | 0 | 0 | 0 | 0 |
| 0 | 0 | 0 | 0 | 0 | 0 | 0 |
| 0 | 0 | 0 | 0 | 0 | 0 | 0 |
| 0 | 0 | 0 | 0 | 0 | 0 | 0 |
| 0 | 0 | 0 | 0 | 0 | 0 | 0 |

FIG.12A

| | | | | | | |
|---|---|---|---|---|---|---|
| 0 | 0 | 0 | 0 | 0 | 0 | 0 |
| 0 | 0 | 0 | 0 | 0 | 0 | 0 |
| 0 | 0 | 0 | 0 | 0 | 0 | 0 |
| 0 | 0 | 0 | 0 | 0 | 0 | 0 |
| 0 | 0 | 0 | 0 | 0 | 0 | 0 |
| 0 | 0 | 0 | 0 | 0 | 0 | 0 |
| 0 | 0 | 0 | 0 | 0 | 0 | 0 |

FIG.12B

| | | | | | | |
|---|---|---|---|---|---|---|
| 0 | 0 | 0 | 0 | 0 | 0 | 0 |
| 0 | 1 | 0 | 0 | 0 | 0 | 0 |
| 0 | 0 | 0 | 0 | 0 | 0 | 0 |
| 0 | 0 | 0 | 0 | 0 | 0 | 0 |
| 0 | 0 | 0 | 0 | 0 | 0 | 0 |
| 0 | 0 | 0 | 0 | 0 | 0 | 0 |
| 0 | 0 | 0 | 0 | 0 | 0 | 0 |

FIG.12C

| | | | | | | |
|---|---|---|---|---|---|---|
| 0 | 0 | 0 | 0 | 0 | 0 | 0 |
| 0 | 0 | 1 | 0 | 0 | 0 | 0 |
| 0 | 0 | 0 | 0 | 0 | 0 | 0 |
| 0 | 0 | 0 | 0 | 0 | 0 | 0 |
| 0 | 0 | 0 | 0 | 0 | 0 | 0 |
| 0 | 0 | 0 | 0 | 0 | 0 | 0 |
| 0 | 0 | 0 | 0 | 0 | 0 | 0 |

FIG.12D

| | | | | | | |
|---|---|---|---|---|---|---|
| 0 | 0 | 0 | 0 | 0 | 0 | 0 |
| 0 | 0 | 0 | 0 | 0 | 0 | 0 |
| 0 | 0 | 0 | 0 | 0 | 0 | 0 |
| 0 | 0 | 0 | 0 | 0 | 0 | 0 |
| 0 | 0 | 0 | 0 | 0 | 0 | 0 |
| 0 | 0 | 0 | 0 | 0 | 0 | 0 |
| 0 | 0 | 0 | 0 | 0 | 0 | 0 |

FIG.12E

| | | | | | | |
|---|---|---|---|---|---|---|
| 0 | 0 | 0 | 0 | 0 | 0 | 0 |
| 0 | 0 | 0 | 0 | 0 | 1 | 0 |
| 0 | 0 | 0 | 0 | 0 | 0 | 0 |
| 0 | 0 | 0 | 0 | 0 | 0 | 0 |
| 0 | 0 | 0 | 0 | 0 | 0 | 0 |
| 0 | 0 | 0 | 0 | 0 | 0 | 0 |
| 0 | 0 | 0 | 0 | 0 | 0 | 0 |

FIG.12F

| | | | | | | |
|---|---|---|---|---|---|---|
| 0 | 0 | 0 | 0 | 0 | 0 | 0 |
| 0 | 0 | 0 | 0 | 0 | 0 | 0 |
| 0 | 0 | 0 | 0 | 0 | 0 | 0 |
| 0 | 0 | 0 | 0 | 0 | 0 | 0 |
| 0 | 0 | 0 | 0 | 0 | 0 | 0 |
| 0 | 0 | 0 | 0 | 0 | 0 | 0 |
| 0 | 0 | 0 | 0 | 0 | 0 | 0 |

FIG.12G

| | | | | | | |
|---|---|---|---|---|---|---|
| 0 | 0 | 0 | 0 | 0 | 0 | 0 |
| 0 | 0 | 0 | 0 | 0 | 0 | 0 |
| 0 | 0 | 0 | 0 | 0 | 0 | 0 |
| 0 | 0 | 0 | 0 | 0 | 0 | 0 |
| 0 | 0 | 0 | 0 | 0 | 0 | 0 |
| 0 | 0 | 0 | 0 | 0 | 0 | 0 |
| 0 | 0 | 0 | 0 | 0 | 0 | 0 |

FIG.12H

| | | | | | | |
|---|---|---|---|---|---|---|
| 0 | 0 | 0 | 0 | 0 | 0 | 0 |
| 0 | 1 | 0 | 0 | 0 | 0 | 0 |
| 0 | 1 | 1 | 0 | 0 | 0 | 0 |
| 0 | 0 | 0 | 0 | 0 | 0 | 0 |
| 0 | 0 | 0 | 0 | 0 | 0 | 0 |
| 0 | 0 | 0 | 0 | 0 | 0 | 0 |
| 0 | 0 | 0 | 0 | 0 | 0 | 0 |

FIG.12I

| | | | | | | |
|---|---|---|---|---|---|---|
| 0 | 0 | 0 | 0 | 0 | 0 | 0 |
| 0 | 0 | 0 | 0 | 1 | 1 | 0 |
| 0 | 0 | 0 | 0 | 1 | 0 | 0 |
| 0 | 0 | 0 | 0 | 0 | 0 | 0 |
| 0 | 0 | 0 | 0 | 0 | 0 | 0 |
| 0 | 0 | 0 | 0 | 0 | 0 | 0 |
| 0 | 0 | 0 | 0 | 0 | 0 | 0 |

FIG.12J

| | | | | | | |
|---|---|---|---|---|---|---|
| 0 | 0 | 0 | 0 | 0 | 0 | 0 |
| 0 | 0 | 0 | 0 | 0 | 0 | 0 |
| 0 | 0 | 0 | 0 | 0 | 1 | 0 |
| 0 | 0 | 0 | 0 | 0 | 0 | 0 |
| 0 | 0 | 0 | 0 | 0 | 0 | 0 |
| 0 | 0 | 0 | 0 | 0 | 0 | 0 |
| 0 | 0 | 0 | 0 | 0 | 0 | 0 |

FIG.12K

| | | | | | | |
|---|---|---|---|---|---|---|
| 0 | 0 | 0 | 0 | 0 | 0 | 0 |
| 0 | 0 | 0 | 0 | 0 | 0 | 0 |
| 0 | 0 | 0 | 0 | 0 | 0 | 0 |
| 0 | 0 | 0 | 0 | 0 | 0 | 0 |
| 0 | 0 | 0 | 0 | 0 | 0 | 0 |
| 0 | 0 | 0 | 0 | 0 | 0 | 0 |
| 0 | 0 | 0 | 0 | 0 | 0 | 0 |

FIG.12L

| | | | | | | |
|---|---|---|---|---|---|---|
| 0 | 0 | 0 | 0 | 0 | 0 | 0 |
| 0 | 0 | 0 | 0 | 0 | 0 | 0 |
| 0 | 0 | 0 | 0 | 0 | 0 | 0 |
| 0 | 0 | 0 | 0 | 0 | 0 | 0 |
| 0 | 0 | 0 | 0 | 0 | 0 | 0 |
| 0 | 0 | 0 | 0 | 0 | 0 | 0 |
| 0 | 0 | 0 | 0 | 0 | 0 | 0 |

FIG.12M

| | | | | | | |
|---|---|---|---|---|---|---|
| 0 | 0 | 0 | 0 | 0 | 0 | 0 |
| 0 | 0 | 0 | 0 | 0 | 0 | 0 |
| 0 | 0 | 0 | 0 | 0 | 0 | 0 |
| 0 | 0 | 0 | 0 | 0 | 0 | 0 |
| 0 | 1 | 1 | 0 | 0 | 0 | 0 |
| 0 | 1 | 0 | 0 | 0 | 0 | 0 |
| 0 | 0 | 0 | 0 | 0 | 0 | 0 |

FIG.12N

| | | | | | | |
|---|---|---|---|---|---|---|
| 0 | 0 | 0 | 0 | 0 | 0 | 0 |
| 0 | 0 | 0 | 0 | 0 | 0 | 0 |
| 0 | 0 | 0 | 0 | 0 | 0 | 0 |
| 0 | 0 | 0 | 0 | 0 | 0 | 0 |
| 0 | 0 | 0 | 0 | 1 | 0 | 0 |
| 0 | 0 | 0 | 0 | 1 | 1 | 0 |
| 0 | 0 | 0 | 0 | 0 | 0 | 0 |

FIG.12O

| | | | | | | |
|---|---|---|---|---|---|---|
| 0 | 0 | 0 | 0 | 0 | 0 | 0 |
| 0 | 0 | 0 | 0 | 0 | 0 | 0 |
| 0 | 0 | 0 | 0 | 0 | 0 | 0 |
| 0 | 0 | 0 | 0 | 0 | 0 | 0 |
| 0 | 0 | 0 | 0 | 0 | 1 | 0 |
| 0 | 0 | 0 | 0 | 0 | 0 | 0 |
| 0 | 0 | 0 | 0 | 0 | 0 | 0 |

FIG.12P

| | | | | | | |
|---|---|---|---|---|---|---|
| 0 | 0 | 0 | 0 | 0 | 0 | 0 |
| 0 | 0 | 0 | 0 | 0 | 0 | 0 |
| 0 | 0 | 0 | 0 | 0 | 0 | 0 |
| 0 | 0 | 0 | 0 | 0 | 0 | 0 |
| 0 | 0 | 0 | 0 | 0 | 0 | 0 |
| 0 | 0 | 0 | 0 | 0 | 0 | 0 |
| 0 | 0 | 0 | 0 | 0 | 0 | 0 |

FIG.12Q

| | | | | | | |
|---|---|---|---|---|---|---|
| 0 | 0 | 0 | 0 | 0 | 0 | 0 |
| 0 | 0 | 0 | 0 | 0 | 0 | 0 |
| 0 | 0 | 0 | 0 | 0 | 0 | 0 |
| 0 | 0 | 0 | 0 | 0 | 0 | 0 |
| 0 | 0 | 0 | 0 | 0 | 0 | 0 |
| 0 | 1 | 0 | 0 | 0 | 0 | 0 |
| 0 | 0 | 0 | 0 | 0 | 0 | 0 |

FIG.12R

| | | | | | | |
|---|---|---|---|---|---|---|
| 0 | 0 | 0 | 0 | 0 | 0 | 0 |
| 0 | 0 | 0 | 0 | 0 | 0 | 0 |
| 0 | 0 | 0 | 0 | 0 | 0 | 0 |
| 0 | 0 | 0 | 0 | 0 | 0 | 0 |
| 0 | 0 | 0 | 0 | 0 | 0 | 0 |
| 0 | 0 | 1 | 0 | 0 | 0 | 0 |
| 0 | 0 | 0 | 0 | 0 | 0 | 0 |

FIG.12S

| | | | | | | |
|---|---|---|---|---|---|---|
| 0 | 0 | 0 | 0 | 0 | 0 | 0 |
| 0 | 0 | 0 | 0 | 0 | 0 | 0 |
| 0 | 0 | 0 | 0 | 0 | 0 | 0 |
| 0 | 0 | 0 | 0 | 0 | 0 | 0 |
| 0 | 0 | 0 | 0 | 0 | 0 | 0 |
| 0 | 0 | 0 | 0 | 0 | 0 | 0 |
| 0 | 0 | 0 | 0 | 0 | 0 | 0 |

FIG.12T

| | | | | | | |
|---|---|---|---|---|---|---|
| 0 | 0 | 0 | 0 | 0 | 0 | 0 |
| 0 | 0 | 0 | 0 | 0 | 0 | 0 |
| 0 | 0 | 0 | 0 | 0 | 0 | 0 |
| 0 | 0 | 0 | 0 | 0 | 0 | 0 |
| 0 | 0 | 0 | 0 | 0 | 0 | 0 |
| 0 | 0 | 0 | 0 | 0 | 1 | 0 |
| 0 | 0 | 0 | 0 | 0 | 0 | 0 |

FIG.12U

| | | | | | | |
|---|---|---|---|---|---|---|
| 0 | 0 | 0 | 0 | 0 | 0 | 0 |
| 0 | 0 | 0 | 0 | 0 | 0 | 0 |
| 0 | 0 | 0 | 0 | 0 | 0 | 0 |
| 0 | 0 | 0 | 0 | 0 | 0 | 0 |
| 0 | 0 | 0 | 0 | 0 | 0 | 0 |
| 0 | 0 | 0 | 0 | 0 | 0 | 0 |
| 0 | 0 | 0 | 0 | 0 | 0 | 0 |

FIG.12V

| | | | | | | |
|---|---|---|---|---|---|---|
| 0 | 0 | 0 | 0 | 0 | 0 | 0 |
| 0 | 0 | 0 | 0 | 0 | 0 | 0 |
| 0 | 0 | 0 | 0 | 0 | 0 | 0 |
| 0 | 0 | 0 | 0 | 0 | 0 | 0 |
| 0 | 0 | 0 | 0 | 0 | 0 | 0 |
| 0 | 0 | 0 | 0 | 0 | 0 | 0 |
| 0 | 0 | 0 | 0 | 0 | 0 | 0 |

FIG. 15 a11

| | | | | | | |
|---|---|---|---|---|---|---|
| 0.0 | 0.0 | 0.5 | 0.8 | 0.5 | 0.0 | 0.0 |
| 0.0 | 0.9 | 1.0 | 1.0 | 1.0 | 0.9 | 0.5 |
| 0.5 | 1.0 | 0.9 | 0.9 | 0.9 | 1.0 | 0.0 |
| 0.8 | 1.0 | 0.9 | 0.9 | 0.9 | 1.0 | 0.8 |
| 0.5 | 1.0 | 0.9 | 0.9 | 0.9 | 1.0 | 0.5 |
| 0.0 | 0.9 | 1.0 | 1.0 | 1.0 | 0.9 | 0.0 |
| 0.0 | 0.0 | 0.5 | 0.8 | 0.5 | 0.0 | 0.0 |

a44 a77

IMAGE DISPLAY APPARATUS

This application is a continuation of U.S. application Ser. No. 11/370,940, filed Mar. 9, 2006, now U.S. Pat. No. 7,432,884 which is a division of U.S. application Ser. No. 10/870,070, filed Jun. 18, 2004, now U.S. Pat. 7,046,219 B2, issued May 16, 2006.

BACKGROUND OF THE INVENTION

1. Field of the Invention

The present invention relates to an image display apparatus.

2. Description of the Related Art

As an image display apparatus, there is conventionally known one using electron emitting devices.

For example, an image display apparatus constituted to use so-called Spindt type electron emitting devices each including a conical electrode and a gate electrode proximate to the conical electrode, an image display apparatus constituted to use surface conduction electron emitting devices as electron emitting devices, an image display apparatus constituted to use carbon nanotubes as electron emitting devices are known.

Examples of the image display apparatuses using the electron emitting devices include those disclosed in Japanese Patent Application Laid-Open (JP-A) Nos. 11-250840 and 11-250839.

Besides the image display apparatus constituted to use electron emitting devices and an illuminant arranged to be distanced from the electron emitting devices, to irradiate electrons emitted from the electron emitting devices to the illuminant, and to thereby cause the illuminant to emit a light, a plasma display apparatus is known. The configuration of the plasma display apparatus is disclosed in, for example, JP-A No. 11-24629.

Further, JP-A No. 2003-29697 discloses that an orbit of electrons emitted from a cold cathode device by charging a spacer is bent in a direction closer to the spacer. The patent document also discloses that an image is often distorted by collision of electrons against a position different from a normal position on a phosphor. Further, the patent document discloses that a luminance of the image near the spacer is often reduced by the collision of electrons emitted from the elements against the spacer. In addition, the patent document discloses the configuration of the image display apparatus constituted so that distances between luminescent spots are irregular, and so that a visual luminance irregularity is reduced by correcting a quantity of light of each luminescent spot.

SUMMARY OF THE INVENTION

Configuration of an image display apparatus capable of realizing more preferable image display is desired. Specifically, the more preferable image display means image display with smaller irregularities.

More specifically, the present inventor discovered that an image display apparatus constituted to use the electron emitting devices and the illuminant arranged to be distanced from the electron emitting devices, to irradiate the electrons emitted from the electron emitting devices to the illuminant, and to thereby cause the illuminant to emit a light has characteristic disadvantages. The present inventor repeatedly conducted experiments of displaying an image while causing an electron source having a plurality of electron emitting devices arranged to face phosphors having different luminous colors, respectively. As a result, the inventor discovered that a color reproductivity of the image display apparatus differs from desired color reproductivity. Specifically, if the phosphors having blue, red, and green luminous colors are used, and electrons are irradiated only to the blue phosphor so as to emit a blue light, then a luminous state is such that not pure blue but a color slightly different from blue, i.e., a color mixed with green and red is emitted, that is, the light is emitted in a luminous state with a low color saturation.

It is an object of the present invention to realize preferable image display.

According to one aspect of the present invention, there is provided an image display apparatus comprising: a plurality of electron emitting devices; an illuminant which includes light emitting regions arranged to be distanced from the electron emitting devices, and emitting lights when being irradiated with electrons emitted from the electron emitting devices, the light emitting regions corresponding to the plurality of electron emitting devices; and a driving circuit which outputs a driving signal for driving the electron emitting devices, characterized in that the driving circuit includes a correction circuit that makes a correction to an input signal, the correction circuit being to output, as the driving signal come of correcting an input signal corresponding to a predetermined electron emitting device, the driving signal corrected to be smaller than the driving signal output when there is no increase in a quantity of emitted light of one of the light emitting regions corresponding to the predetermined electron emitting device, when there is an increase in the quantity of emitted light of the light emitting region corresponding to the predetermined electron emitting device, the increase resulting from the electrons emitted from the electron emitting devices proximate to the predetermined electron emitting device.

As the illuminant, a phosphor can be used. The "light emitting regions" means herein regions which do not overlap with one another. The increase in the quantity of emitted light of the light emitting regions corresponding to the predetermined electron emitting device, the increase resulting from the electrons emitted from the electron emitting devices proximate to the predetermined electron emitting device, is an increase in the quantity of emitted light caused by reflection of the electrons emitted from the proximate electron emitting devices, and incidence of the electrons on the light emitting region corresponding to the predetermined electron emitting device, an increase in the quantity of emitted light caused by incidence of secondary electrons generated by the electrons emitted from the proximate electron emitting devices on the light emitting region corresponding to the predetermined electron emitting device.

According to the one aspect of the present invention, in particular, the image display apparatus can appropriately adopt constitution such that the driving circuit makes the correction based on a value obtained by an evaluation of the increase in the quantity of emitted light. In addition, the image display apparatus can appropriately adopt a constitution such that the driving circuit performs an operation for the evaluation based on input signals input to the driving circuit as signals corresponding to the proximate electron emitting devices. The image display apparatus can particularly, appropriately adopt a constitution such that the correction is made based on the value obtained by the evaluation of the increase in the quantity of emitted light of the emitting region corresponding to the predetermined electron emitting device, the increase resulting from the electrons emitted from a plurality of electron emitting devices proximate to the predetermined electron emitting device. The image display apparatus can particularly, appropriately adopt a constitution such that the correction is made based on the value obtained by the evaluation based on the input signal.

Further, the image display apparatus can appropriately adopt constitution such that the driving circuit makes the correction based on a value obtained by multiplying a plurality of input signals input to the driving circuit to correspond to a plurality of electron emitting devices, by a coefficient for the evaluation of the increase in the quantity of emitted light of the light emitting region corresponding to the predetermined electron emitting device, the increase resulting from the electrons emitted from the plurality of electron emitting devices. As a correction value for making the correction "based on a value obtained by multiplying a plurality of input signals input to the driving circuit to correspond to a plurality of electron emitting devices, by a coefficient for the evaluation of the increase in the quantity of emitted light of the light emitting region corresponding to the predetermined electron emitting device, the increase resulting from the electrons emitted from the plurality of electron emitting devices", a value corresponding to a sum of values obtained by multiplying the plurality of input signals input to correspond to the electron emitting devices, by a coefficient for evaluating the increase in the quantity of emitted light of the light emitting region corresponding to the predetermined electron emitting device, the increase resulting from the electrons emitted from the plurality of electron emitting devices, can be used.

Further, according to the one aspect of the present invention, the image display apparatus can appropriately adopt constitution such that the driving circuit includes, as a circuit that outputs a correction value for making the correction, a circuit which calculates a sum of the plurality of input signals input to the driving circuit to correspond to the plurality of electron emitting devices, and which outputs a value obtained by multiplying the sum by the coefficient. If the coefficient is constant irrespective of which input signal the coefficient is multiplied by, a value obtained by multiplying the respective input signals by the coefficient and by summing the multiplication results can be used. In addition, a value obtained by calculating a sum of the respective input signals, and by multiplying the sum by the coefficient can be used. Among them, since a rounding error can be reduced, the value obtained by calculating a sum of the respective input signals, and by multiplying the sum by the coefficient is appropriately used as the correction value for the correction made "based on a value obtained by multiplying a plurality of input signals input to the driving circuit to correspond to a plurality of electron emitting devices, by a coefficient for the evaluation of the increase in the quantity of emitted light of the light emitting region corresponding to the predetermined electron emitting device, the increase resulting from the electrons emitted from the plurality of electron emitting devices". Alternatively, before calculating the sum of the respective input signals, a degree of a contribution of the electrons emitted from the respective electron emitting devices driven by the respective input signals to the increase in the quantity of emitted light of the light emitting region corresponding to the predetermined light emitting element can be corrected for the respective input signals. The correction can be made by multiplying the respective input signals by the coefficient which reflects on the degree of contribution.

Furthermore, according to the one aspect of the present invention, the image display apparatus can appropriately adopt constitution such that the apparatus further comprises an electron shield member which suppresses irradiation of the electrons to light emitting regions other than the light emitting region corresponding to a electron emitting device, the irradiation resulting from the said electrons emitted from the electron emitting devices, and such that the driving circuit includes a circuit which evaluates the increase in the quantity of emitted light of the light emitting region corresponding to the predetermined electron emitting device, the increase resulting from the electrons emitted from the electron emitting devices proximate to the predetermined electron emitting device, by performing an operation based on the input signals corresponding to the proximate electron emitting devices, the circuit being a circuit which performs the operation while excluding the input signals corresponding to the proximate electron emitting devices which do not cause the increase in the quantity of emitted light of the light emitting region corresponding to the predetermined electron emitting device by causing the electrons to be shielded by the electron shield member.

According to another aspect of the present invention, there is provided an image display apparatus comprising: a plurality of electron emitting devices; an illuminant which includes light emitting regions arranged to be distanced from the electron emitting devices, and emitting lights by being irradiated with electrons emitted from the electron emitting devices, the light emitting regions corresponding to the plurality of electron emitting devices; an electron shield member which suppresses irradiation of the electrons to the light emitting regions other than the light emitting regions corresponding to the electron emitting devices, the irradiation resulting from the electrons emitted from the electron emitting devices; and a driving circuit which outputs a driving signal for driving the electron emitting devices, characterized in that the driving circuit includes a correction circuit which makes a correction to an input signal, the correction circuit being a circuit which outputs, as the driving signal for driving the electron emitting device corresponding to the light emitting region having a smaller increase in a quantity of emitted light, the increase resulting from the electrons emitted from electron emitting devices proximate to a predetermined electron emitting device, a driving signal corrected so as to increase the quantity of the light of the light emitting region corresponding to the electron emitting device by irradiation of the electrons from the corresponding electron emitting device, when the increase in the quantity of emitted light of the light emitting region corresponding to the predetermined electron emitting device, the increase resulting from the electrons emitted from the proximate electron emitting devices, differs due to a difference in a quantity of electrons shielded by the electron shield member, depending on which electron emitting device is the predetermined electron emitting device.

According to this another aspect of the present invention, the image display apparatus can appropriately adopt constitution such that the driving circuit makes the correction using, as a correction value, a value obtained by an evaluation of the increase in the quantity of emitted light if the electrons are not shielded by the electron shield member (which may be referred to as a value obtained by the evaluation of a quantity of electrons shielded by the electron shield member). In addition, the image display apparatus can appropriately adopt constitution such that the driving circuit performs an operation for the evaluation based on input signals input to the driving circuit as signals corresponding to the proximate electron emitting devices.

Further, according to the another aspect of the present invention, the image display apparatus can appropriately adopt constitution such that the driving circuit makes the correction based on a value obtained by multiplying a plurality of input signals input to correspond to a plurality of electron emitting devices, by a coefficient for evaluating the increase in the quantity of emitted light of the light emitting region corresponding to the electron emitting device corresponding to the corrected driving signal, the increase resulting from the electrons emitted from the plurality of electron emitting devices if the electrons are not shielded by the electron shield member.

According to yet another aspect of the present invention, there is provided an image display apparatus comprising: a plurality of electron emitting devices; an illuminant which includes light emitting regions arranged to be distanced from the electron emitting devices, and emitting lights by being irradiated with electrons emitted from the electron emitting devices, the light emitting regions corresponding to the plurality of electron emitting devices; an electron shield member which shields the electrons resulting from the electrons emitted from the electron emitting device corresponding to a predetermined light emitting region, and which thereby suppresses irradiation of the electrons resulting from the electrons emitted from the electron emitting devices corresponding the predetermined light emitting region to the light emitting regions other than the predetermined light emitting region; and a driving circuit which outputs a driving signal for driving the electron emitting devices, characterized in that the driving circuit includes a correction circuit for outputting the driving signal corrected, the correction circuit being a circuit which makes a correction based on a value obtained by an evaluation of a quantity of the electrons shielded by the electron shield member.

According to still another aspect of the present invention, there is provided an image display apparatus comprising: a plurality of electron emitting devices; an illuminant which includes light emitting regions arranged to be distanced from the electron emitting devices, and emitting lights by being irradiated with electrons emitted from the electron emitting devices, the light emitting regions corresponding to the plurality of electron emitting devices; an electron shield member which shields the electrons emitted from the electron emitting device corresponding to a predetermined light emitting region and reflected by the illuminant or a member near the illuminant, and which thereby suppresses irradiation of the reflected electrons to the light emitting regions other than the predetermined light emitting region; and a driving circuit which outputs a driving signal for driving the electron emitting devices, characterized in that the driving circuit includes a correction circuit for outputting corrected the driving signal, the correction circuit being a circuit that reduces a visual irregularity caused by non-uniformity of an effect of electron shield by the electron shield member.

An example of a member corresponding to the electron shield member includes a spacer that maintains a distance between the electron emitting devices and the illuminant.

Further, according to each aspect of the present invention, the present invention is particularly effective if the illuminant includes a plurality of the light emitting regions having different luminous colors, and the electron emitting devices proximate to the predetermined electron emitting device include at least the electron emitting devices corresponding to the light emitting regions for the luminous colors different from the luminous color of the light emitting region corresponding to the predetermined electron emitting device.

BRIEF DESCRIPTION OF THE DRAWINGS

FIG. 5, including

FIG. 7 shows values of coefficients a11 to a77;

FIG. 8 shows values of coefficients a11 to a77;

FIG. 12 shows values of coefficients a11 to a77;

FIG. 15 shows values of coefficients a11 to a77;

DETAILED DESCRIPTION OF THE PREFERRED EMBODIMENTS

After conducting repeated studies, the present inventor confirmed that the reason for the reduction in color saturation that occurs to the conventional image display apparatus using the electron emitting devices is that electrons emitted from the electron emitting devices are incident on not only a corresponding light emitting region but also neighborhood (including adjacent) light emitting regions of different colors. As a result of dedicated studies therefor, the present inventor contrived novel configuration of an image display apparatus capable of improving the conventional disadvantages, and a driving signal correction method.

Exemplary embodiments of the image display apparatus and the driving signal correction method according to the present invention will be described herein after.

For brevity of description, the following embodiments will be described on the assumption of a display apparatus wherein image data input to the display apparatus is linear to a display luminance.

In the following embodiments, if a predetermined light emitting region and light emitting regions adjacent to the predetermined light emitting region are present, light emission of the light emitting regions adjacent to the predetermined region which occurs with emission of electrons from electron emitting devices corresponding to the predetermined light emitting region to the predetermined light emitting region is also referred to as "halation" herein after.

First Embodiment

A filter employed to lessen image quality degradation caused by halation and a filter processing will be described as a first embodiment of the present invention.

An image display apparatus according to the first embodiment includes an image plane composed by a plurality of pixels. The respective pixels include light emitting regions of a plurality of different colors, particularly red (R), green (G), and blue (B). As an illuminant that constitutes these light emitting regions, a phosphor that emits a light when being irradiated with electrons is used. An electron emitting device which irradiates electrons to the red light emitting region, an electron emitting device which irradiates electrons to the green light emitting region, and an electron emitting device which irradiates electrons to the blue light emitting region are provided to correspond to each pixel. In this embodiment, surface conduction electron emitting devices are employed as suited electron emitting devices.

Figure 16:
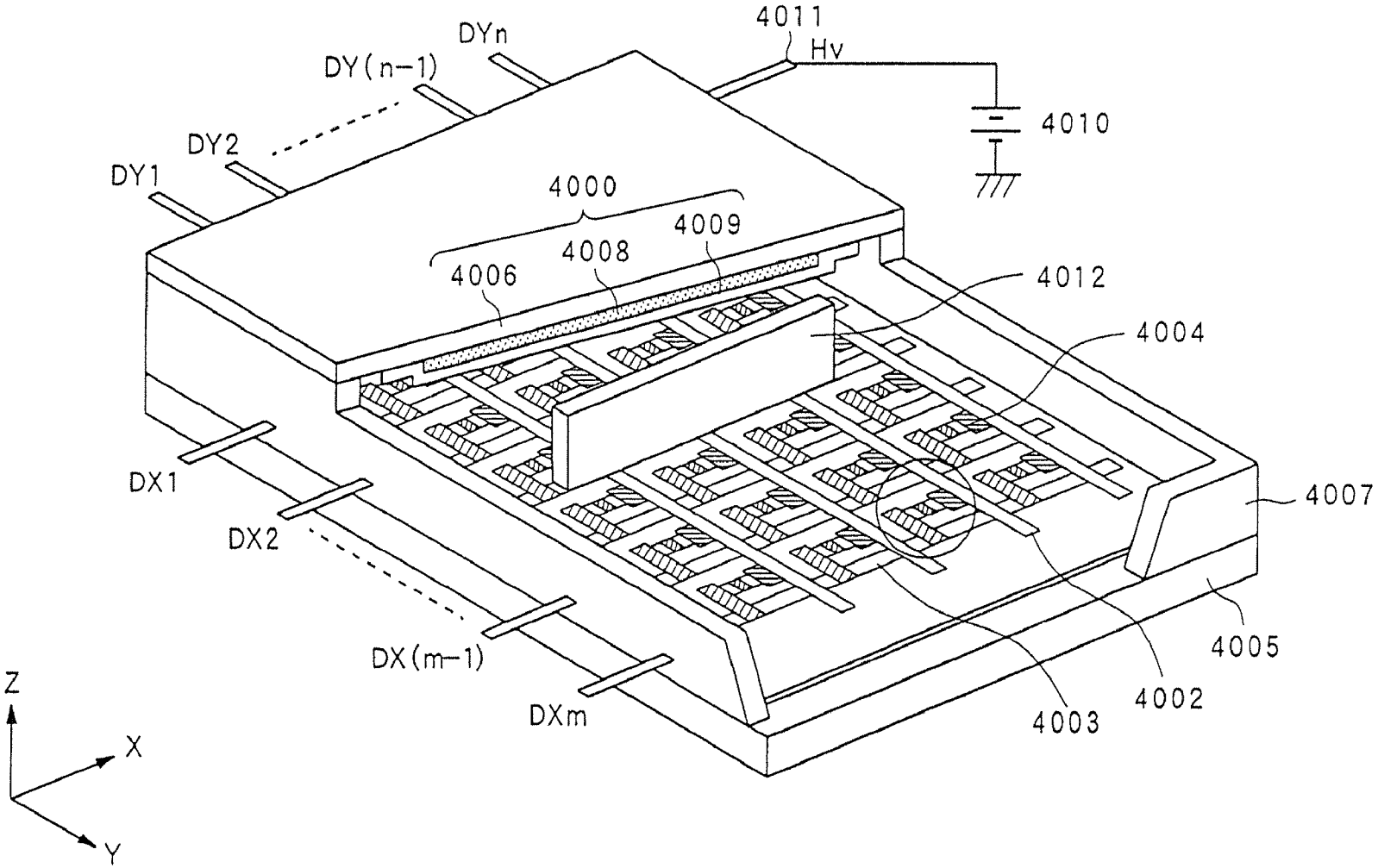
FIG. 16 shows a configuration of a display section employed in the first to the seventh embodiments of the present invention.

FIG. 16 shows configuration of a display section of the image display apparatus according to each of embodiments to be described later.

Figure 17:
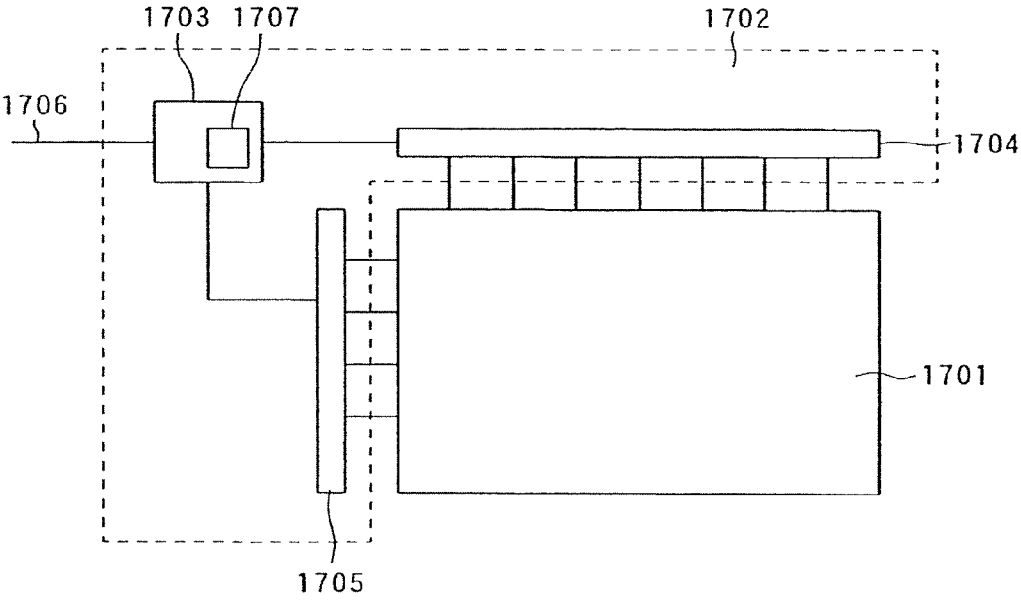
FIG. 17 shows an image display apparatus according to the first to the seventh embodiments.

FIG. 17 shows configuration of the image display apparatus according to each of the embodiments to be described later. This image display apparatus includes the display section 1701 and a driving circuit 1702. The configuration of the display section 1701 is shown in FIG. 16. The driving circuit 1702 includes a modulated signal output circuit 1704, a scanning signal output circuit 1705, and a signal processing circuit 1703. The modulated signal output circuit 1704 supplies a modulated signal to the display section 1701. The scanning signal output circuit 1705 supplies a scanning signal to the display section 1701. The signal processing circuit 1703 processes an external signal (e.g., a signal from a computer) input through an input line 1706, a broadcast signal received by an antenna included in the signal processing circuit 1703, or the like, generates a gradation signal and a timing signal, and supplies the generated signals to the modulated signal output circuit 1704 and the scanning signal output circuit 1705. The signal processing circuit 1703 includes a correction circuit 1707, which performs a correction processing to be described later.

The display section 1701 shown in FIG. 16 includes electron emitting devices and the illuminant. As each of the electron emitting devices, an arbitrary electron emitting device such as a Spindt-type electron emitting device including a combination of an emitter cone and a gate electrode, an electron emitting device using a carbon fiber such as a carbon nanotube or a graphite fiber, or an MIM-type electron emitting device can be used. In the embodiments of the present invention, a surface conduction electron emitting device 4004 is used as a particularly suited electron emitting device. In addition, the display section 1701 adopts a configuration in which a plurality of surface conduction electron emitting devices 4004 are connected in the form of a matrix by a plurality of scanning signal application wirings 4002 and a plurality of modulated signal application wirings 4003. The scanning signal output from the scanning signal output circuit 1705 is sequentially applied to the scanning signal application wirings 4002. The modulated signal output from the modulated signal output circuit 1704 is sequentially applied to the modulated signal application wirings 4003. The electron emitting devices 4004, the scanning signal application wirings 4002 to which the matrix of the electron emitting devices 4004 is connected, the modulated signal application wirings 4003 to which the matrix of the electron emitting devices 4004 is connected are provided on a glass plate 4005 that serves as a substrate.

In the embodiments shown in FIG. 16, a phosphor 4008 is used as the illuminant. The phosphor 4008 is provided on a glass plate 4006 that serves as a substrate. A metal back 4009 that serves as an acceleration electrode for accelerating the electrons emitted from the respective electron emitting devices 4004 is also provided on the glass substrate 4006. An accelerated potential is supplied to the metal back 4009 from a power supply 4010 through a high voltage terminal 4011. A glass frame 4007 that serves as an outer frame is located between the glass plates 4005 and 4006, the glass plate 4005 and the glass frame 4007 are airtight sealed from each other, and the glass plate 4006 and the glass frame 4007 are airtight sealed from each other. An airtight container is thereby constituted by the glass plate 4005, the glass plate 4006, and the glass frame 4007. An interior of the airtight container is kept vacuum. A spacer 4012 is provided in the airtight container, thereby preventing the airtight container from being broken by a pressure difference between the interior and an exterior of the airtight container.

In the display section 1701 constituted as shown in FIG. 16, the light emitting regions corresponding to the electron emitting devices 4004 are located at positions substantially opposed to the electron emitting devices 4004, respectively.

Figure 1:
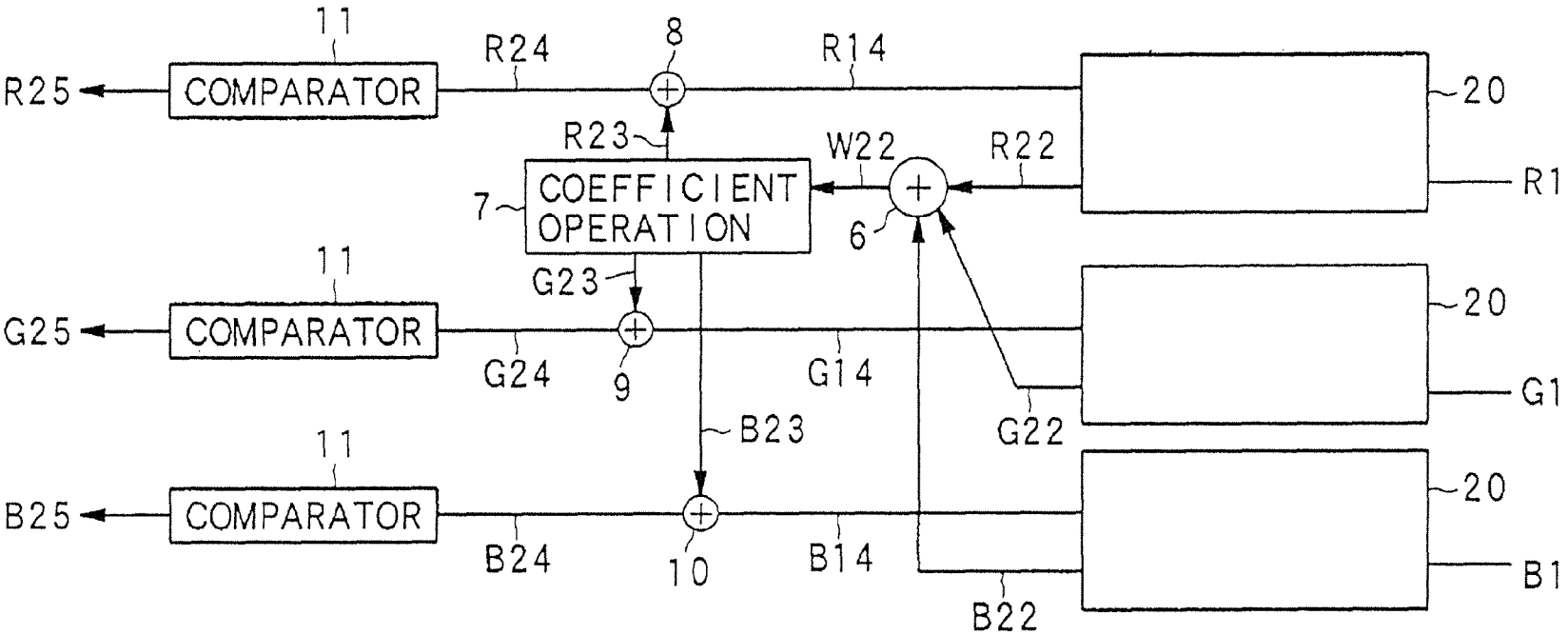
FIG. 1 is a circuit block diagram according to first to third embodiments of the present invention.

FIG. 1 is a circuit diagram which shows the configuration of the correction circuit 1707 according to the first embodiment. In FIG. 1, reference symbol 20 denotes a neighborhood data integration section (integration circuit), 6 denotes an RGB addition section (addition circuit), 7 denotes a coefficient operation section (correction value calculation circuit), 8, 9, and 10 denote adders (driving signal generation circuits) and 11 denotes a comparator. Three neighborhood data integration sections 20 equal in configuration are provided for the colors R, G, and B, respectively.

Pieces of sampled digital R, G, and B data R1, G1, and B1 are input first to the corresponding neighborhood data integration sections 20 as input signals, respectively. The RGB data are assumed to be linear to a luminance. If the RGB data are nonlinear to the luminance, the RGB data may be converted into data linear to the luminance by a table or the like.

Figure 2:
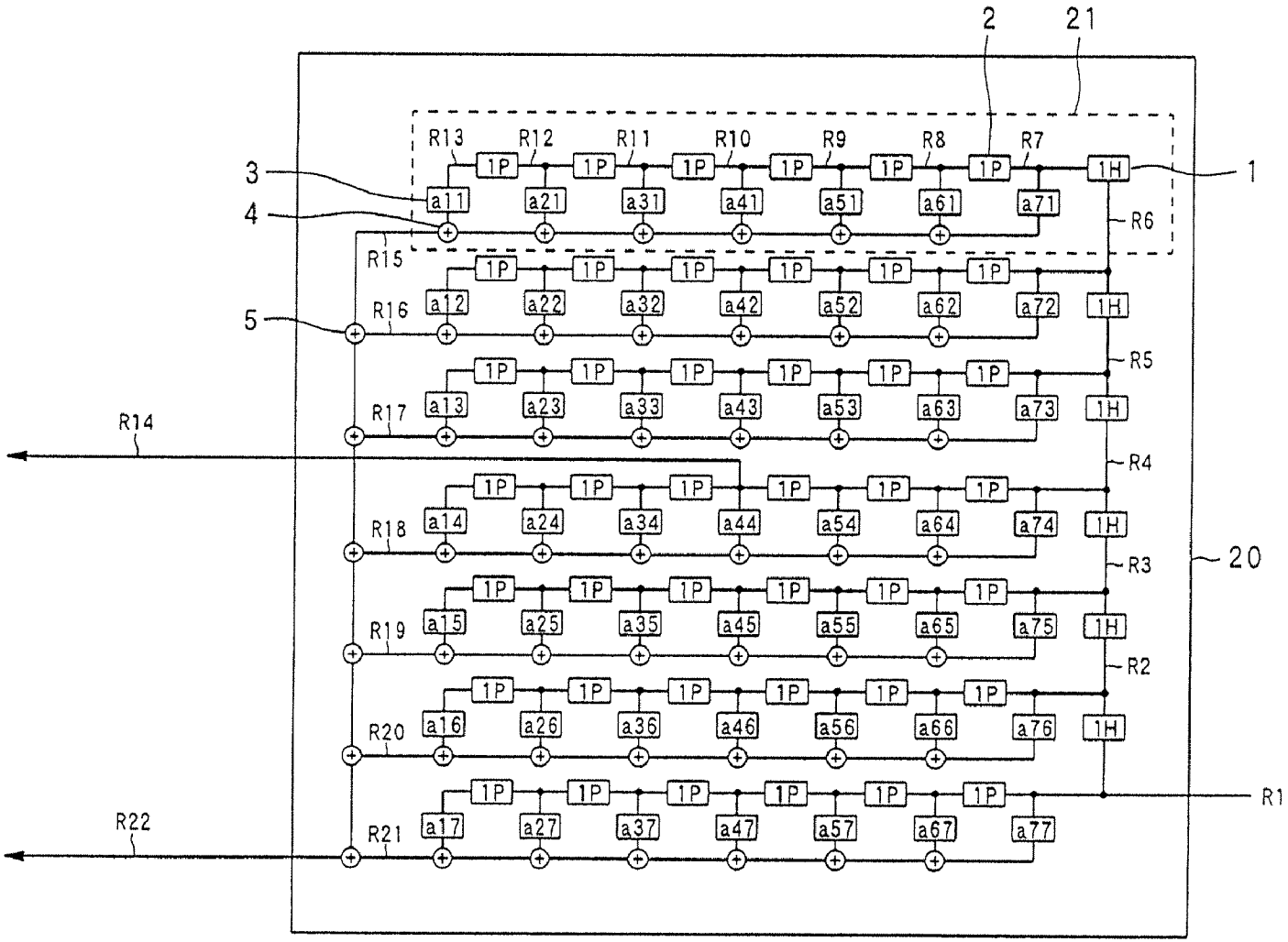
FIG. 2 is a detailed view of a neighborhood data integration section.

FIG. 2 is a detailed view of the neighborhood data integration section 20 shown in FIG. 1. In FIG. 2, reference symbol 1 denotes a one-horizontal-synchronizing-period (herein after, "1H") delay circuit, 2 denotes a one-pixel (herein after, "1P") delay circuit, 3 denotes a multiplier which multiplies data by a coefficient, 4 denotes a horizontal adder which integrates data horizontally, and 5 denotes a vertical adder which integrates the horizontally integrated data vertically.

Referring to FIG. 2, processings of the neighborhood data integration section 20 will be described The pieces of sampled digital R, G, and B signals R1, G1, and B1 are input to the respective neighborhood data integration sections 20. Since the neighborhood data integration sections 20 are entirely equal in configuration irrespective of the colors R, G, and B, the neighborhood data integration section 20 for the color R will be typically described herein.

The 1H delay circuit 1 will first be described. The data R1 input to the neighborhood data integration section 20 is delayed by 1H by one 1H delay circuit 1. It is assumed herein that a signal obtained by delaying the R1 by 1H is R2, a signal obtained by delaying the R2 by 1H is R3, a signal obtained by delaying the R3 by 1H is R4, a signal obtained by delaying R4 by 1H is R5, a signal obtained by delaying R5 by 1H is R6, and a signal obtained by delaying R6 by 1H is R7.

Since image data is normally input from row data on the image plane, the signal R2 is always data one row upper than the data R1. Likewise, the signal R3 is data one row upper than the signal R2, the signal R4 is data one row upper than the signal R3, the signal R5 is data one row upper than the signal R4, the signal R6 is data one row upper than the signal R5, and the signal R7 is data one row upper than the signal R6.

The 1P delay circuit 2 will next be described. The 1P delay circuit 2 delays data by one pixel in a horizontal direction. For example, a signal R8 is a signal obtained by delaying the signal R7 by one pixel. Since the image data is normally input from left data on the image plane, the signal R8 is always image data on the left of the signal R7. Likewise, the signal R9 is always image data on the left of the signal R8, the signal R10 is always image data on the left of the signal R9, the signal R11 is always image data on the left of the signal R10, the signal R12 is always image data on the left of the signal R11, and the signal R13 is always image data on the left of the signal R12. In this embodiment, the 1P delay circuits 2 have been described, while referring to an uppermost row 21. The 1P delay circuit 2 carries out the same processing in which ever row in the neighborhood data integration section 20.

It is assumed herein that data (herein after, "pixel-of-interest data") at a vertical and horizontal center (herein after, "pixel of interest") in the neighborhood data integration section 20 is R14. The pixel-of-interest data R14 is delayed horizontally by three pixels from the R4. Namely, the pixel-of-interest data R14 is data displayed at the pixel moved left by three pixels from the display pixel for the data R4. At the same time, the pixel-of-interest data R14 is data displayed at a pixel moved downward by three pixels from the display pixel for the data R10.

If attention is paid to the pixel-of-interest data R14, data in the neighborhood data integration section 20 is data in a rectangle of seven vertical pixels and seven horizontal pixels around the pixel of interest. For example, the R10 is data three pixels upper than the data R14, R4 is data three pixels right of the data R14, and R7 is data three pixels upper than and three pixels right of R14. In other words, the neighborhood data integration section 20 can process data corresponding to the seven vertical pixels and the seven horizontal pixels around the pixel-of-interest data. This is normally referred to as a seven-tap filter.

The number of filter taps (seven in this embodiment) is determined according to a range influenced by a halation. In this embodiment, when electrons are irradiated to a certain phosphor, circular light emission due to the halation occurs about pixels of the phosphor. If a diameter of a circular region influenced by the halation to be considered is n pixels, a filter having n taps is necessary.

In this embodiment, the number of filter taps is set at seven (n=7). However, if the range influenced by the halation to be considered is only upper, lower, left, and right pixels adjacent to the pixel of interest, a filter having three filter taps (n=3) may be used.

The diameter of the region influenced by the halation depends on a distance between a face plate, on which the phosphor is arranged, and a rear plate on which a electron source is arranged. The number of filter taps can be, therefore, determined according to the distance between the face plate and the rear plate.

Figure 3:
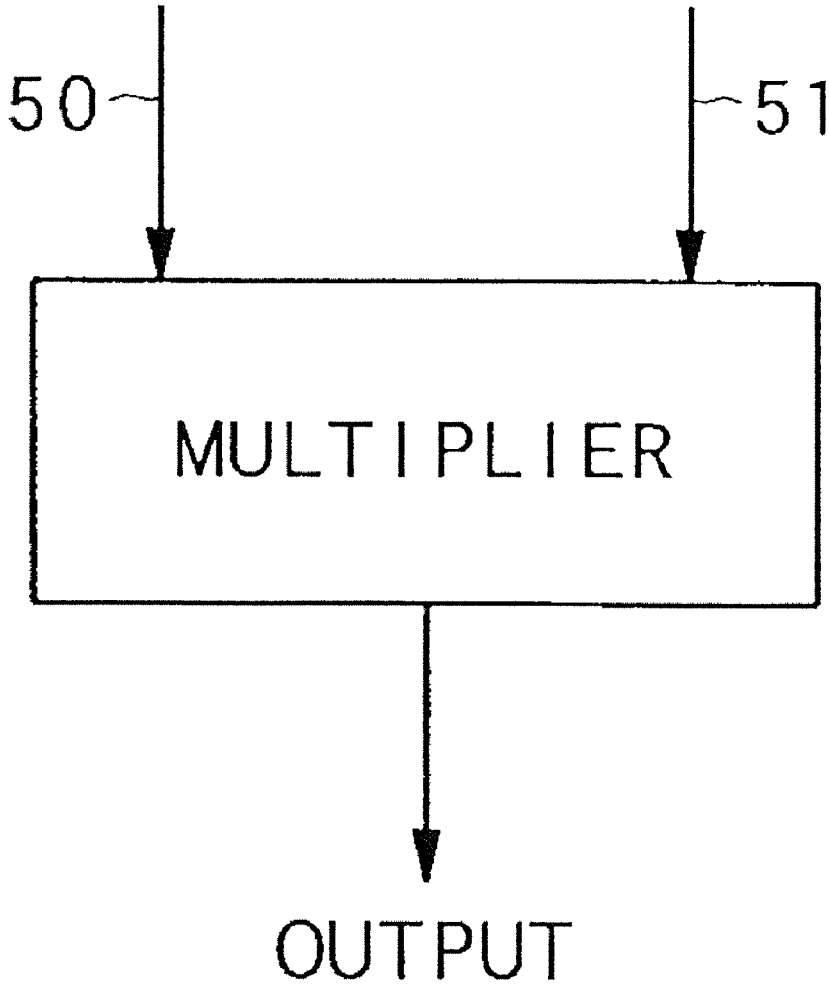
FIG. 3 is a detailed view of an adder.

The multiplier 3 will next be described. FIG. 3 shows the configuration of the multiplier 3. The multiplier 3 outputs a result of multiplying two inputs 50 and 51. In this embodiment, the input 50 is data and the input 51 is a coefficient by which the data is multiplied. If the data 50 is, for example, the data R13 shown in FIG. 2, the coefficient 51 is a11. While the multiplier is originally constituted as shown in FIG. 3, a coefficient is indicated in each multiplier 3 for brevity in FIG. 2.

As shown in FIG. 2, the neighborhood data integration section 20 is constituted so that the data R12 is multiplied by a coefficient a21, the data R11 is multiplied by a coefficient a31, the data R10 is multiplied by a coefficient a41, the data R9 is multiplied by a coefficient a51, the data R8 is multiplied by a coefficient a61, and the data R7 is multiplied by a coefficient a71. In this embodiment, the processings of the multipliers 3 has been described while referring to the uppermost row 21 in the neighborhood data integration section 20. However, the multipliers 3 carries out the same processings in which ever row in the neighborhood data integration section 20.

The horizontal adders 4 add up data in one row. In this embodiment, the number of horizontal adders 4 per row is six. Since the horizontal adders 4 are provided for each of seven rows, the total number of horizontal adders 4 necessary in the neighborhood data integration section 20 is 6×4=42. The data input to each horizontal adder 4 is an output of the multiplier 3. It is the horizontal adders 4 that add up data output from the multipliers 3 in one row.

If referring to the uppermost row 21 in the neighborhood data integration section 20, the processings of the multipliers 3 and the horizontal adders 4 are expressed by the following Equation 1.

$$R15=R13\times a11+R12\times a21+R11\times a31+R10\times a41+R9\times a51+R8\times a61+R7\times a71 \quad (1)$$

The processings carried out in the uppermost row 21 in the neighborhood data integration section 20 have been described above. The same processings are carried out in which ever row in the neighborhood data integration section 20. The coefficients a11 to a77 will be described later in detail.

Pieces of the neighborhood data integrated horizontally are added up vertically by the vertical adders 5. If the neighborhood data in the respective rows output from the horizontal adders 4 are R15 to R21 as shown in FIG. 2, an output value R22 of the vertical adder 5 is expressed by the following Equation 2.

$$R22=R15+R16+R17+R18+R19+R20+R21 \quad (2)$$

In this embodiment, the output value R22 will be referred to as "neighborhood data integrated value". The neighborhood data integrated value R22 is a value obtained by integrating the neighborhood data R14 at the pixel of interest data R14 by weights of the coefficients a11 to a77. The neighborhood data integration section 20 thus outputs two signals, i.e., the pixel-of-interest data R14 and the neighborhood data integrated value R22.

The processings described above are those carried out by the neighborhood data integration section 20. Although only the example of processings for the color R has been described above, completely the same processings are carried out for the colors G and B. For the color G, the neighborhood data integration section 20 outputs pixel-of-interest data G14 and a neighborhood data integrated value G22. For the color B, the neighborhood data integration section 20 outputs pixel-of-interest data B14 and a neighborhood data integrated value B22.

Processings to be carried out after the processings of the neighborhood data integration sections 20 will next be described with reference to FIG. 1. The neighborhood data integrated values R22, G22, and B22 output from the respective neighborhood data integration sections 20 are added up by the RGB addition section 6. If an output of the RGB addition section 6 is assumed as W22, W22 is expressed by the following Equation 3.

$$W22=R22+G22+B22 \quad (3)$$

The output W22 is obtained by integrating the neighborhood data on the pixel of interest by the coefficients a11 to a77 for each of the colors R, G, and B, and integrating resultant all pieces of neighborhood data for the colors R, G, and B. Namely, using the neighborhood data integration sections 20 and the RGB addition section 6, a sum of the input signals corresponding to the electron emitting devices proximate to the predetermined electron emitting device (that constitutes the pixel of interest) is obtained. In the display apparatus which display an image using the electron emitting devices by irradiating electrons from each electron emitting device to the corresponding phosphor, the electrons from the electron emitting device are irradiated to the corresponding phosphor with directivity. Therefore, it is assumed that the electrons from the electron emitting device corresponding to the phosphor of a predetermined color is not irradiated to the phosphors of colors other than the predetermined color. Due to this, the display apparatus is not constituted to completely partition the electron emitting devices from one another by barriers so as to prevent color mixture. The present inventor, however, discovered that even if the electrons from a certain electron emitting device are irradiated to the corresponding phosphor, reflected electrons generated by irradiated electrons are irradiated to the neighborhood phosphors, and recognized that the reflected electrons generated by the electrons irradiated to the phosphor of the predetermined color from the certain electron emitting device are incident on the phosphors of the other colors to thereby reduce color saturation. Therefore, the neighborhood data on the pixel of interest are multiplied by the respective coefficients and the neighborhood data for all colors of R, G, and B are added up, i.e., the data W22 is used to calculate a correction value for the pixel-of-interest data without correcting pieces of pixel-of-interest data for the respective colors, independently of one another.

The coefficient operation section 7 multiplies the input data W22 by a predetermined coefficient. This coefficient is intended to reflect a degree of the influence of the halation on the correction value, and determined as follows.

It is assumed herein that an intensity of light emission (light emission without ahalation, herein after, "luminescent spot") by irradiation of electrons from the electron source is LO, and an intensity of halation-causing light emission is LI. A coefficient k used by the coefficient operation section 7 is determined by the following Equation 4.

$$k=L1/L0 \tag{4}$$

In the Equation 4, a value of the coefficient k can be obtained by an experiment. Normally, the intensity L0 is higher than L1, so that k is a value between 0 and 1.

After multiplying the input signal W22 by the coefficient k, the coefficient operation section 7 inverts a sign of the resultant signal and outputs the sign-inverted signal. Therefore, output data R23, G23, and B23 of the coefficient operation section 7 are expressed by the following Equation 5.

$$R23=G23=B23=-k\times W22 \tag{5}$$

Pieces of data R23, G23, and B23 are correction values added to the pieces of pixel-of-interest data R14, G14, and B14 by the adders 8, 9, and 10, respectively. Pieces of output data R24, G24, and B24 of the respective adders 8, 9, and 10 are expressed by the following Equations 6, 7, and 8.

$$R24=R14+R23=R14-k\times W22 \tag{6}$$

$$G24=G14+G23=G14-k\times W22 \tag{7}$$

$$B24=B14+B23=B14-k\times W22 \tag{8}$$

The comparator 11 compares the input data with zero, and outputs a greater value. Therefore, pieces of output data R25, G25, and B25 of the comparators 11 are expressed by the following Equations 9, 10, and 11, respectively.

$$R25 = R24 \ (\text{if } R24 > 0) \quad = 0 \ (\text{if } R24 \le 0) \tag{9}$$

$$G25 = G24 \ (\text{if } G24 > 0) \quad = 0 \ (\text{if } G24 \le 0) \tag{10}$$

$$B25 = B24 \ (\text{if } B24 > 0) \quad = 0 \ (\text{if } B24 \le 0) \tag{11}$$

The coefficients a11 to a77 used in the neighborhood data integration section 20 will next be described.

Figures 4A, 4B:
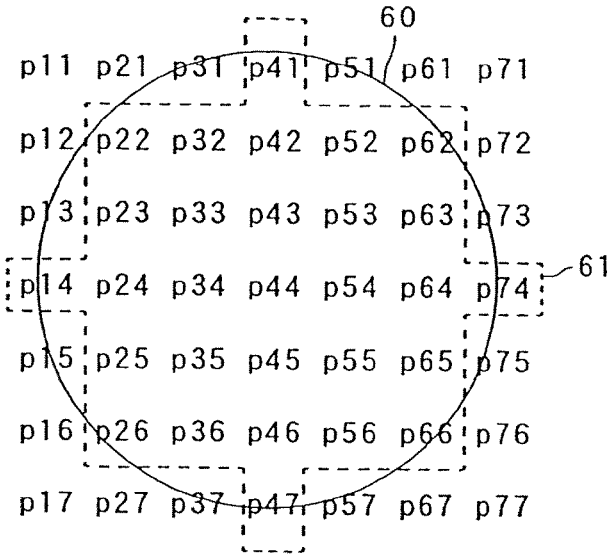
FIG. 4A shows arrangement of pixels around a pixel of interest.
FIG. 4B shows values of coefficients a11 to a77.

FIG. 4A shows arrangement of seven vertical pixels and horizontal vertical pixels about a pixel of interest p44 if a certain pixel p44 is the pixel of interest. In FIG. 4A, pnm (where n and m are integers ranging from 1 to 7) represents a pixel. It is assumed that at a certain timing, coefficients by which the pieces of data at the pixels p11 to p77 are multiplied are assumed as a11 to a77, respectively.

The image display apparatus according to this embodiment is constituted so that halation-causing light emission occurs to a circular region about the luminescent spot. In FIG. 4A, a solid line 60 denotes the region to which the halation-causing light emission occurs when the pixel of interest p44 is turned on. In this embodiment, to simplify the coefficients a11 to a77, a circle indicated by the solid line 60 is approximated to a shape indicated by a dotted line 61. Namely, it is approximated that halation-causing light emission occurs to pixels surrounded by the dotted line 61 when the pixel of interest p44 is turned on.

The pixels to which the halation-causing light emission occurs when the pixel of interest p44 is turned on are those surrounded by the dotted line 61. This, in turn, means that if the pixels surrounded by the dotted line 61 are turned on, the halation-causing light emission occurs to the pixel of interest p44 by reflected electrons by the pixels.

In this embodiment, each of the coefficients a11 to a77 is assumed to be either zero or one. The coefficients of the pixels which may possibly induce halation-causing light emission of the pixel of interest p44 are one, and the coefficients of the other pixels are zero. The pixels which may possibly induce the halation-causing light emission of the pixel of interest p44 are those within the dotted line 61 shown in FIG. 4A. Therefore, the coefficients a11 to a77 are those shown in FIG. 4B. In FIG. 4B, an upper left coefficient is the coefficient a11, a lower right coefficient is the coefficient a77, and a central coefficient is the coefficient a44 of the pixel of interest p44.

In this embodiment, it is assumed that the pixels which may possibly induce the halation-causing light emission of the pixel of interest p44 are those in a 7×7 pixel region. If the region is, for example, a 3×3 pixel region, then the coefficients of the upper, lower, left, and right pixels of the pixel of interest p44, i.e., the coefficients a43, a34, a54, and a45 may be set at one, and the other coefficients may be set at zero. If the reflected electrons reflected by the pixel of interest p44 are not irradiated to the pixel of interest p44, the coefficient a44 of the pixel of interest p44 may be set at zero.

In this embodiment, the halation-causing light emission occurs to the circular region around the luminescent spot. It is already known that the halation-causing light emission intensity L1 is substantially uniform to all the pixels within the circular region. Therefore, the coefficients within the circular region are all equal.

If the coefficients a11 to a77 are set as stated above, the neighborhood data integrated values R22, G22, and B22 shown in FIG. 1 are integrated values of data at the pixels that induces the halation-causing light emission to the pixel of interest p44 for the respective colors of R, G, and B. Since the halation is light emission mainly caused by the reflected electrons, the halation occurs to the image display apparatus that uses the electron emitting devices irrespective of the colors R, G, and B. Namely, the reflected electrons for the color R also cause the pixels of interest for the colors G and B to emit lights. Needless to say, the reflected electrons for each of the colors G and B cause the pixels of interest of the other colors. Therefore, the image display apparatus according to this embodiment is constituted so that halation data for the other colors can be subtracted from the pixel-of-interest data for one color so as to suppress the reduction in color saturation.

The RGB addition section 6 integrates the neighborhood data integrated values R22, G22, and B22 for the colors R, G, and B, respectively. The integrated value W22 of pixel data on all the colors that may induce the halation-causing light emission of the pixels of interest for all the colors is obtained.

Data R24, G24, and B24 obtained by multiplying the data W22 by the coefficient k and subtracting the multiplication result from the pixel-of-interest data R14, G14, and B14, are data from which the halation-causing light emission quantities are subtracted, respectively. The coefficient operation section 7 multiplies the data W22 by the coefficient k, inverts the sign of the multiplication result, and outputs the sign-inverted data. By adding the sign-inverted data R23, R23, and B23 (R23=G23=B23; the sign of the R23, G23, and B23 is −) to the pixel-of-interest data R14, G14, and B14, display data R24, G24, and B24 from which the halation-causing light emission quantities are subtracted, respectively are obtained.

At this time, if R23 is greater than R14, R24 is negative. In this case, the comparator 11 outputs zero. The data R25, G25, and B25 thus obtained are image data from which halation-causing light emission quantities are subtracted, respectively. If the electron emitting devices that constitute the image display apparatus are driven based on the data, then the halation-causing light emission quantities subtracted from the respective pieces of image data are added by an actual halation, and the image display apparatus emits a light at a desired luminance and a desired chromaticity. Namely, by setting display data on a predetermined color at a value based on neighborhood data on the other colors, display can be realized at a suited chromaticity.

Figure 5A:
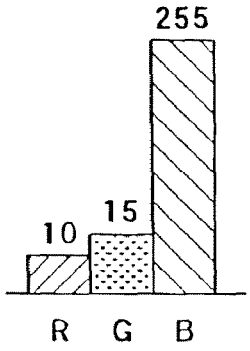
FIGS. 5A to 5C shows explanatory views for correction carried out in the first embodiment.
Figure 5B:
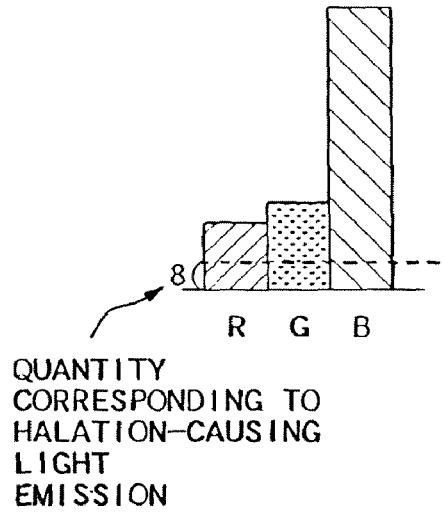
Figure 5C:
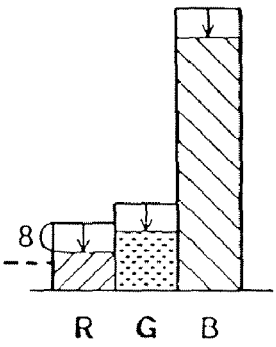

FIGS. 5A to 5C show one example of R, G, and B data values if attention is paid to a certain pixel. It is assumed that original data has R=10, G=15, and B=255 as shown in FIG. 5A. This is data which appears substantially blue by the display apparatus without halation.

If the data is displayed without carrying out the correction according to this embodiment, the data is displayed while a halation from the neighborhood pixels is added to the data as shown in FIG. 5B. The halation often occurs to the pixel of interest. However, since the halation that occurs to the 7×7 pixel region is considered herein, an intensity of this halation is substantially equal among the colors R, G, or B. It is assumed that the halation intensity is a quantity corresponding to eight in the image data. This quantity corresponds to the data R23, G23, or B23 shown in FIG. 1. If this image is observed, the image appears blue having a slightly low color saturation (blue close to sky blue).

The correction carried out according to this embodiment is intended to display the image data by subtracting the halation-causing light emission quantities from the respective pieces of image data as shown in FIG. 5C. Taking the above assumption (that the halation intensity is a quantity corresponding to eight) as an example, the halation-causing light emission quantity corresponds to eight in each image data. Therefore, after subtracting eight from the image data, the electron emitting devices are driven for the data of R=2, G=7, and B=247, thereby displaying an image. As a result, when the image is displayed, the halation-causing light emission is added to the image data by the actual halation, the color saturation of the data reduced by the halation is corrected to the color saturation of the original data, and the image is displayed at the same RGB luminance, the same color saturation, and the same chromaticity as those of the original data.

For brevity, the first embodiment has been described on the premise of the image display apparatus wherein the image data input to the image display apparatus is linear to the display luminance. If the display apparatus wherein the image data is nonlinear to the display luminance, the data may be displayed after converting the data into data suited for display characteristics using a table or the like.

In this embodiment, not only the halation that occurs to the pixel of interest but also the halation that occurs to the 7×7 pixel region are considered. For a light emission region of interest, the influence of which electron emitting devices other than the electron emitting devices corresponding to the light emission region of interest, on the light emission state of the light emission region of interest is to be considered can be appropriately determined. By setting the coefficients a11 to a77 to be used in the neighborhood data integration section 20 according to the determination, targets for which the halation is to be considered can be selected.

Second Embodiment

The display section 1701 shown in FIG. 16 includes the spacer 4012. The spacer 4012 is intended to prevent the airtight container from being broken by the pressure difference between the interior and the exterior of the airtight container. This spacer 4012 functions to shield electrons resulting from the electrons emitted from a predetermined electron emitting device (a part of the electrons emitted from the predetermined electron emitting device, and directly progressed toward light emitting regions corresponding to the other electron emitting devices, or electrons emitted from the predetermined electron emitting device, reflected by the illuminant (the phosphor) or the member near the illuminant (the substrate on which the phosphor is arranged or the metal back serving as the acceleration electrode), and progressed toward the light emitting regions corresponding to the other electron emitting devices), and to thereby suppress the electrons from being irradiated to the light emission regions corresponding to the other electron emitting devices. A rib or the like provided on the glass substrate 4005 or 4006 may be used as the electron shield member which exhibits this electron shield function. If such an electron shield member is arranged to have a uniform positional relationship relative to all the electron emitting devices, the electron shield function can be fulfilled for the respective electron emitting devices. However, if the electron shield member is not arranged uniformly in the display section 1701 as shown in the spacer 4012 showed by FIG. 16, the electron shield function of the electron shield member corresponding to the respective electron emitting devices is not uniformly fulfilled. For example, the electrons resulting from the electrons emitted by a certain electron emitting device near the spacer 4012 are shielded by the spacer 4012 and do not reach the light emitting region corresponding to the electron emitting device opposite to the certain electron emitting device across the spacer 4012. The electron shield function of this spacer 4012 is not fulfilled for the electron emitting devices sufficiently distant from the spacer 4012. As a result, the electron shield function of the spacer 4012 is fulfilled in a non-uniform manner.

As a second embodiment of the present invention, an instance of changing the processings according to the first embodiment only for neighborhoods of the spacer 4012 (electron shield member) will be described. In the neighborhoods of the spacer 4012, reflected electrons are shielded by the spacer 4012, so that the halation intensity is reduced. If the filter as described in the first embodiment is provided in the neighborhoods of the spacer 4012 similarly to non-neighborhoods of the spacer 4012, the neighborhoods of the spacer 4012 are disadvantageously, excessively corrected. This embodiment is intended to solve this disadvantage by changing the coefficients a11 to a77 in the neighborhoods of the spacer 4012.

The correction circuit 1707 and the neighborhood data integration section 20 according to the second embodiment are equal in configuration to those shown in FIGS. 1 and 2 except that the coefficients a11 to a77 used in the neighborhood data integration sections 20 are changed.

Figure 6:
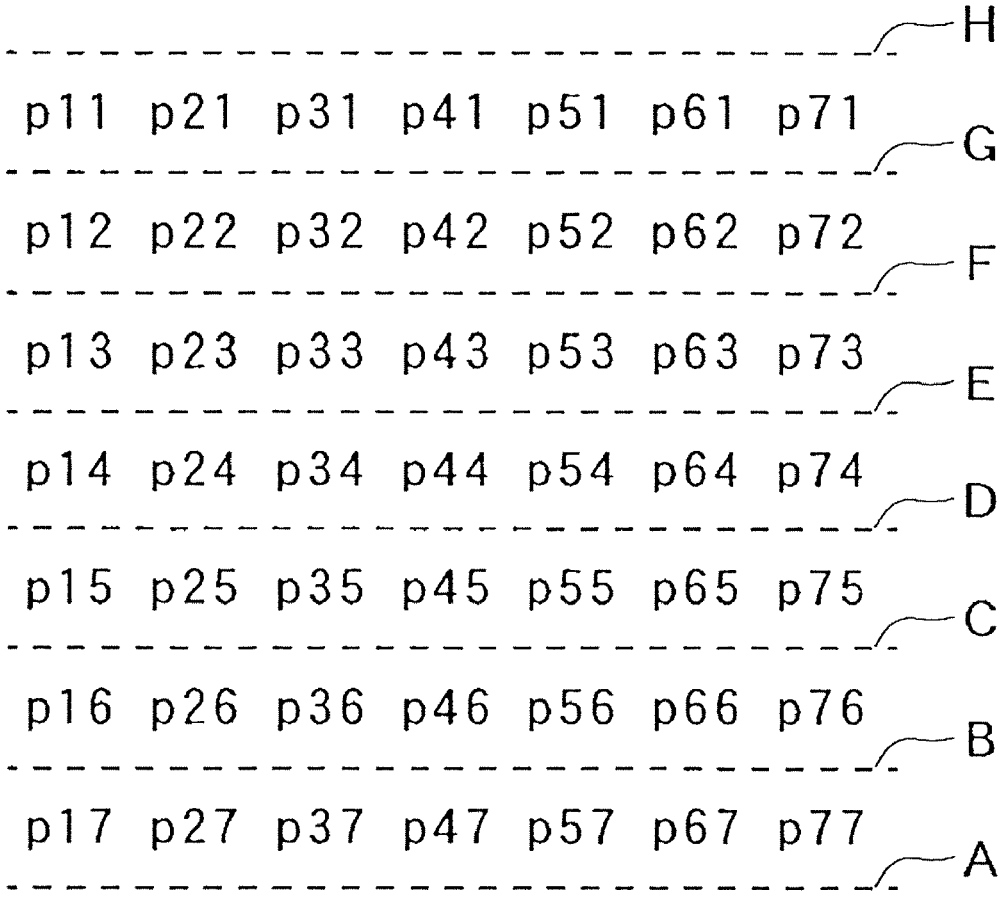
FIG. 6 shows arrangement of pixels and a spacer around the pixel of interest.

The pixels in the seven taps in the neighborhood data integration section 20 are assumed as p11 to p77 as shown in FIG. 6. The coefficients a11 to a77 shown in FIG. 2 are coefficients by which the pixel data on the pixels p11 to p77 are multiplied, respectively.

In this embodiment, the spacer 4012 is a plate member arranged at a center between a certain pixel row and a row just below the certain pixel row.

A pixel row just above the spacer 4012 is referred to as an upper first neighbor, a pixel row just above the first upper neighbor is referred to as an upper second neighbor, a pixel row just above the upper second neighbor is referred to as an upper third neighbor, etc. For example, if the spacer 4012 is located at a position A in FIG. 6, the upper first neighbor is a row of the pixels p17 to p77, the upper second neighbor is a row of the pixels p16 to p76, and the upper third neighbor is a row of the pixels p15 to p75. Likewise, a pixel row just below the spacer 4012 is referred to as a lower first neighbor, a pixel row just below the lower first neighbor is referred to as a lower second neighbor, a pixel row just below the lower second neighbor is referred to as a lower third neighbor, etc. For example, if the spacer 4012 is located at a position B in FIG. 6, the lower first neighbor is a row of the pixels p17 to p77.

In this embodiment, it is assumed that a vertical resolution of the image display apparatus is 768, and that 20 spacers are arranged at intervals of 40 rows.

If the spacer 4012 is located at the position A in FIG. 6, then the electrons irradiated to the pixel of interest p44 by the emission of electrons from the electron emitting devices corresponding to the neighborhood pixels of the pixel of interest p44 are not shielded by the spacer 4012 for the following reasons. (These electrons are mainly a part of the electrons emitted from the electron emitting devices corresponding to the neighborhood pixels of the pixel of interest p44, reflected by the electron emitting devices, and irradiated to the pixel of interest p44. Therefore, they will be also simply referred to as "reflected electrons".) A lower limit of the pixel rows corresponding to the electron emitting devices that generate the reflected electrons irradiated to the pixel of interest p44 is the row of the pixels p1 to p77. In addition, the reflected electrons generated by the electron emitting devices corresponding to the pixel rows lower than the row of the pixels p17 to p77 are not irradiated to the pixel of interest p44, irrespective of the presence of the spacer 4012. Therefore, if the spacer 4012 is located at the position A in FIG. 6, the coefficients a11 to a77 are those shown in FIG. 4B similarly to the first embodiment.

If the spacer 4012 is located at a position B in FIG. 6, then the reflected electrons generated by the electron emitting devices corresponding to the pixel opposite to the pixel of interest p44 relative to the spacer 4012 among those irradiated to the pixel of interest p44 are shielded by the spacer 4012. The reflected electrons emitted from the electron emitting devices corresponding to the pixels p17 to p37 and p57 to p77 are not irradiated to the pixel of interest p44 irrespective of the presence of the spacer 4012. The reflected electrons generated by the electron emitting devices corresponding to the pixel p47 are shielded by the spacer 4012.

As described in the first embodiment, the neighborhood data integration section 20 calculates the integrated value of pieces of image data that induce the halation-causing light emission of the pixel of interest. Therefore, the pixel data the reflected electrons corresponding to which are shielded by the spacer 4012 and which do not induce the halation-causing light emission should be excluded from the integrated value. As a result, if the spacer 4012 is located at the position B in FIG. 6, then the coefficient a47 is zero and the coefficients a11 to a77 are, therefore, those shown in FIG. 7A.

If the spacer 4012 is located at a position C in FIG. 6, the reflected electrons to be irradiated to the pixel of interest p44 are similarly shielded by the spacer 4012. In this case, the reflected electrons generated by the electron emitting devices corresponding to the pixels p26 to p66 and p47 opposite to the pixel of interest p44 across the spacer 4012 are shielded by the spacer 4012. The reflected electrons generated by the electron emitting devices corresponding to the pixels p16, p76, p17 to p37, and p57 to p77 are not irradiated to the pixel of interest p44 irrespective of the presence of the spacer 4012. As a result, the coefficients a11 to a77 are those shown in FIG. 7B.

Likewise, if the spacer 4012 is located at a position D in FIG. 6, the coefficients a11 to a77 are those shown in FIG. 7C.

The instances in which the pixel of interest p44 is located above the spacer 4012 have been described so far. If the spacer 4012 is located at a position E in FIG. 6, the pixel of interest p44 is below the spacer 4012. In this case, the reflected electrons generated by the electron emitting devices corresponding to the pixels below the pixel of interest p44 are not shielded by the spacer 4012. Therefore, the coefficients a14 to a77 for the pixels below the pixel of interest p44 are the same as those in the first embodiment. The reflected electrons generated by the electron emitting devices corresponding to the pixels above the pixel of interest p44, by contrast, are shielded by the spacer 4012. Therefore, the coefficients a11 to a73 are all zero. If the spacer 4012 is located at a position E in FIG. 6, the coefficients a11 to a77 are those shown in FIG. 7D.

Likewise, if the spacer 4012 is located at a position F in FIG. 6, the coefficients a11 to a72 for the pixels opposite to the pixel of interest p44 across the spacer 4012 are zero, and the other coefficients are the same as those in the first embodiment. Accordingly, if the spacer 4012 is located at the position E in FIG. 6, the coefficients a11 to a77 are those shown in FIG. 7E.

If the spacer 4012 is located at a position G in FIG. 6, the coefficients a11 to a77 are those shown in FIG. 7F.

If the spacer 4012 is located at a position H in FIG. 6, the reflected electrons irradiated to the pixel of interest p44 are not shielded again by the spacer 4012. Due to this, the coefficients a11 to a77 are those shown in FIG. 4B similarly to the first embodiment.

The switching of the coefficients is carried out in blank periods in horizontal synchronizing periods. For example, if the spacer 4012 is located at the position A in FIG. 6, the coefficients a11 to a77 set at values shown in FIG. 4B. In this case, the pixels p17 to p77 are pixels in the upper first neighbor. Since the pieces of input data R1, G1, and B1 are pixel data at the pixel 77, they are data on the upper first neighbor.

If the spacer 4012 is located at the position B in FIG. 6, then the pixels p17 to p77 are the pixels in the lower first neighbor, and the input data R1, G1, and B1 are data on the lower first neighbor. At this time, the pixels p17 to p77 are set at the values shown in FIG. 7A. In the blank period in which the pieces of input data are switched from the upper first neighbor data to the lower first neighbor data, the coefficients a11 to a77 are switched from those shown in FIG. 4A to those shown in FIG. 7A.

If the spacer 4012 is located at the position C in FIG. 6, then the pixels p17 to p77 are the pixels in the lower second neighbor, and the pieces of input data R1, G1, and B1 are data on the lower second neighbor. At this time, the pixels p17 to p77 are set at values shown in FIG. 7B. In the blank period in which the pieces of input data are switched from the lower first neighbor data to the lower second neighbor data, the coefficients a11 to a77 are switched from those shown in FIG. 7A to those shown in FIG. 7B.

Likewise, in the blank period in which the pieces of input data are switched from the lower second neighbor data to the lower third neighbor data, the coefficients a11 to a77 are switched from those shown in FIG. 7B to those shown in FIG. 7C. In the blank period in which the pieces of input data are switched from the lower third neighbor data to the lower fourth neighbor data, the coefficients a11 to a77 are switched from those shown in FIG. 7C to those shown in FIG. 7D. In the blank period in which the pieces of input data are switched from the lower fourth neighbor data to the lower fifth neighbor data, the coefficients a11 to a77 are switched from those shown in FIG. 7D to those shown in FIG. 7E. In the blank period in which the pieces of input data are switched from the lower fifth neighbor data to the lower sixth neighbor data, the coefficients a11 to a77 are switched from those shown in FIG. 7E to those shown in FIG. 7F. In the blank period in which the pieces of input data are switched from the lower sixth neighbor data to the lower seventh neighbor data, the coefficients a11 to a77 are switched from those shown in FIG. 7F to those shown in FIG. 4B.

By so switching, the neighborhood data integrated values R22, G22, and B22 do not include the data corresponding to the reflected electrons shielded by the spacer 4012, but include only the data corresponding to the reflected electrons irradiated to the pixel of interest p44. Similarly to the first embodiment, the RGB addition section 6 adds up the R22, G22, and B22 and outputs the data W22. The coefficient operation section 7 multiplies the data W22 by the coefficient k, and subtracts the resultant data from each of the pixel-of-interest data R14, G14, and G14.

Consequently, the appropriate correction can be conducted even to the neighborhoods of the spacer 4012 without correcting the halation shielded by the spacer 4012.

Third Embodiment

As a third embodiment of the present invention, an instance of applying data corresponding to the halation (herein after, "halation data") to pixel data in the neighborhoods of the spacer 4012 will be described. In the neighborhoods of the spacer 4012, the reflected electrons are shielded by the spacer 4012. Therefore, the halation intensity is reduced in the non-neighborhoods of the spacer 4012, and a luminance irregularity and a color irregularity occurs due to the presence of the spacer 4012. In this embodiment, the non-neighborhoods of the spacer 4012 are not corrected but only the neighborhoods of the spacer 4012 are corrected so as to make the luminance and the chromaticity in the neighborhoods of the spacer 4012 equal to those in the non-neighborhoods of the spacer 4012.

In the third embodiment, similarly to the second embodiment, the spacer 4012 is a plate member arranged at a center between a certain pixel row and a row just below the certain pixel row. It is assumed that a vertical resolution of the image display apparatus is 768, and that 20 spacers are arranged at intervals of 40 rows.

The correction circuit 1707 and the neighborhood data integration section 20 according to the third embodiment are equal in configuration to those shown in FIGS. 1 and 2 except that the coefficients a11 to a77 used in the neighborhood data integration sections 20 are changed, and that the coefficient operation section 7 does not invert the sign of data when outputting the data. The same constituent elements as those in the first embodiment are denoted by the same reference symbols and will not be described herein.

First, an instance in which the pixel of interest is in the non-neighborhoods of the spacer 4012 will be described. Specifically, an instance in which the spacer 4012 is located at the position A or H, or present outward of the positions A and H relative to the pixel of interest p44 will be considered. In other words, the instance is equivalent to an instance in which the pixel of interest p44 is not present between the upper third neighbor and the lower third neighbor. If so, the reflected electrons irradiated to the pixel of interest p44 are not shielded by the spacer 4012, and no luminance irregularity and no chromaticity irregularity caused by the presence of the spacer 4012 occur.

In this embodiment, the neighborhood data integration section 20 calculates the integrated value of the data at the pixels for which the reflected electrons are irradiated to the pixel of interest p44 if the spacer 4012 is not present but are shielded by the spacer 4012 because of the presence of the spacer 4012. In this case, since no such pixel is present, the coefficients a11 to a77 are all set at zero as shown in FIG. 8A. The pieces of output data R22, G22, and B22 of the neighborhood integration sections 20 shown in FIG. 1 are all zero, and the output W22 of the RGB addition section 6 which adds up these pieces of output data is also zero.

In the first and the second embodiments, the coefficient operation section 7 multiplies the input data W22 by the coefficient k, inverts the sign of the resultant data, and outputs the sign-inverted data. In this embodiment, by contrast, the coefficient operation section 7 multiplies the input data W22 by the coefficient k, and outputs the resultant signal without inverting the sign. In the instance stated above, however, since the input signal W22 is zero, the outputs R23, G23, and B23 of the coefficient operation section 7 are also zero.

The outputs of the adders 8, 9, and 10 are expressed by the following Equation 12.

$$R24=R14+R23=R14$$

$$G24=G14+G23=G14$$

$$B24=B14+B23=B14 \tag{12}$$

The pieces of pixel-of-interest data R14, G14, and are output as they are. The comparators 11 carry out the processings expressed by the Equations 9, 10, and 11, respectively. The outputs R25, G25, and B25 of the comparators 11 are equal to the pixel-of-interest data R14, G14, and B14, respectively. As a result, the data subjected to no correction is displayed.

As stated above, if the pixel of interest p44 is in the non-neighborhoods of the spacer 4012, no correction is carried out and the pieces of input data are displayed as they are.

An instance in which the pixel of interest p44 is located in the neighborhoods of the spacer 4012 will next be described. If the spacer 4012 is located at the position B in FIG. 6, then the reflected electrons generated by the electron emitting devices corresponding to the pixels located opposite to the pixel of interest p44 across the spacer 4012 among those irradiated to the pixel of interest p44 are shielded by the spacer 4012. The reflected electrons generated by the electron emitting devices corresponding to the pixels p17 to p37 and p57 to p77 are not irradiated to the pixel of interest p44 irrespective of the presence of the spacer 4012. The reflected electrons generated by the electron emitting devices corresponding to the pixel p47 are shielded by the spacer 4012.

In this embodiment, the neighborhood data integration section 20 calculates the integrated value of the data at the pixels for which the reflected electrons are irradiated to the pixel of interest p44 if the spacer 4012 is not present but are shielded by the spacer 4012 because of the presence of the spacer 4012. Accordingly, if the spacer 4012 is located at the position B in FIG. 6, the coefficient a47 is one and the other coefficients are zero, that is, the coefficients a11 to a77 are those shown in FIG. 8B.

If the coefficients a11 to a77 are those shown in FIG. 8B, the outputs R22, G22, and B22 of the neighborhood data integration sections 20 are equal to the R, G, and B pixel data at the pixel p47, respectively. The RGB adder 6 adds up the outputs R22, G22, and B22, and outputs the data W22. The coefficient operation section 7 multiplies the data W22 by the coefficient k. The output data R23, G23, and B23 of the coefficient operation section 7 correspond to pieces of halation data which are shielded by the spacer 4012 and which are not irradiated to the pixel of interest p44. The adders 8, 9, and 10 add these pieces of data, i.e., the halation data R23, G23, and B23 which are irradiated to the pixels of interest without the spacer 4012, to the pixel-of-interest data R14, G14, and B14, respectively.

In this embodiment, the coefficient operation section 7 does not invert the sign of the data, so that outputs of the adders 8, 9, and 10 are always positive. Due to this, irrespective of the presence of the comparators 11, the following Equation 13 is always satisfied.

$$R25=R24$$

$$G25=G24$$

$$B25=B24 \tag{13}$$

If the spacer 4012 is located at the position C in FIG. 6, the reflected electrons to be irradiated to the pixel of interest p44 are shielded by the spacer 4012 similarly to the above. If so, the reflected electrons generated by the electron emitting devices corresponding to the pixels p26 to p66 and p47 opposite to the pixel of interest p44 across the spacer 4012 are shielded by the spacer 4012. The reflected electrons generated by the electron emitting devices corresponding to the pixels p16, p76, p17 to p37, and p57 to p77 are not irradiated to the pixel of interest p44 irrespective of the presence of the spacer 4012. In this embodiment, the coefficients for the pixels for which the reflected electrons are shielded by the spacer 4012 are all one, so that the coefficients a11 to a77 are those shown in FIG. 8C.

In this case, the pieces of output data R23, G23, and B23 of the coefficient operation section 7 correspond to pieces of halation data which are not irradiated to the pixel of interest p44 since they are shielded by the spacer 4012, respectively. The adders 8, 9, and 10 add the pieces of data R23, G23, and B23 to the pixel-of-interest data R14, G14, and B14, respectively.

Likewise, if the spacer 4012 is located at the position D in FIG. 6, the coefficients a11 to a77 are those shown in FIG. 8D. Similarly, the pixels for which the coefficients a11 to a77 are one are the pixels for which the reflected electrons are shielded by the spacer 4012.

If the spacer 4012 is located at the position E in FIG. 6, the pixels for which the reflected electrons are shielded by the spacer 4012 are moved upward of the spacer 4012. In this case, the coefficients a11 to a77 are those shown in FIG. 8E. Likewise, if the spacer 4012 is located at the position F in FIG. 6, the coefficients a11 to a77 are those shown in FIG. 8F. If the spacer 4012 is located at the position G in FIG. 6, the coefficients a11 to a77 are those shown in FIG. 8G.

The switching of the coefficients is carried out in blank periods in the horizontal synchronizing periods. This switching operation is equal to that according to the second embodiment.

By carrying out these processings to apply the pieces of halation data shielded by the spacer 4012 to the pixel of interest p44 as the image data, the neighborhoods of the spacer 4012 are corrected. As a result, the difference in image quality between the neighborhoods of the spacer 4012 and the non-neighborhoods of the spacer 4012 can be reduced.

Fourth Embodiment

As a fourth embodiment of the present invention, an instance of applying halation data to the pixel data on neighborhood pixels of the spacer 4012 similarly to the third embodiment will be described. It is noted, however, that the spacer (electron shield member) 4012 is a cylindrical member, and arranged at a center between a certain pixel and a pixel just below the certain pixel. In addition, the spacers 4012 are arranged at intervals of 40 vertical and horizontal pixels.

Figure 9:
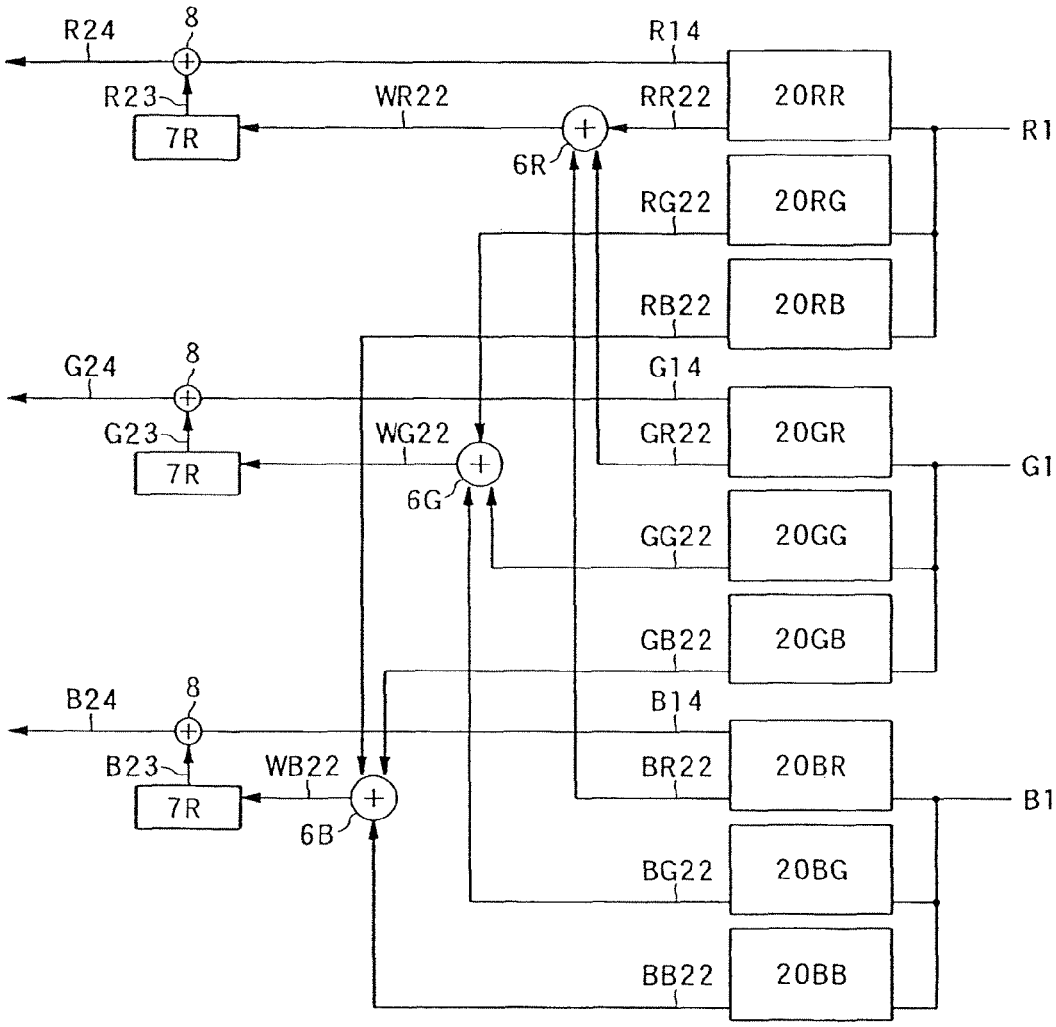
FIG. 9 is a circuit block diagram according to a fourth embodiment of the present invention.

FIG. 9 shows a circuit diagram according to this embodiment. In FIG. 9, reference symbols 20RR, 20RG, 20RB, 20GR, 20GG, 20GB, 20BR, 20GB, and 20BB denote neighborhood data integration sections, 6R, 6G, and 6B denote RGB addition sections, 7R, 7G, and 7B denote coefficient operation sections, and 8, 9, and 10 denote adders.

Figure 10:
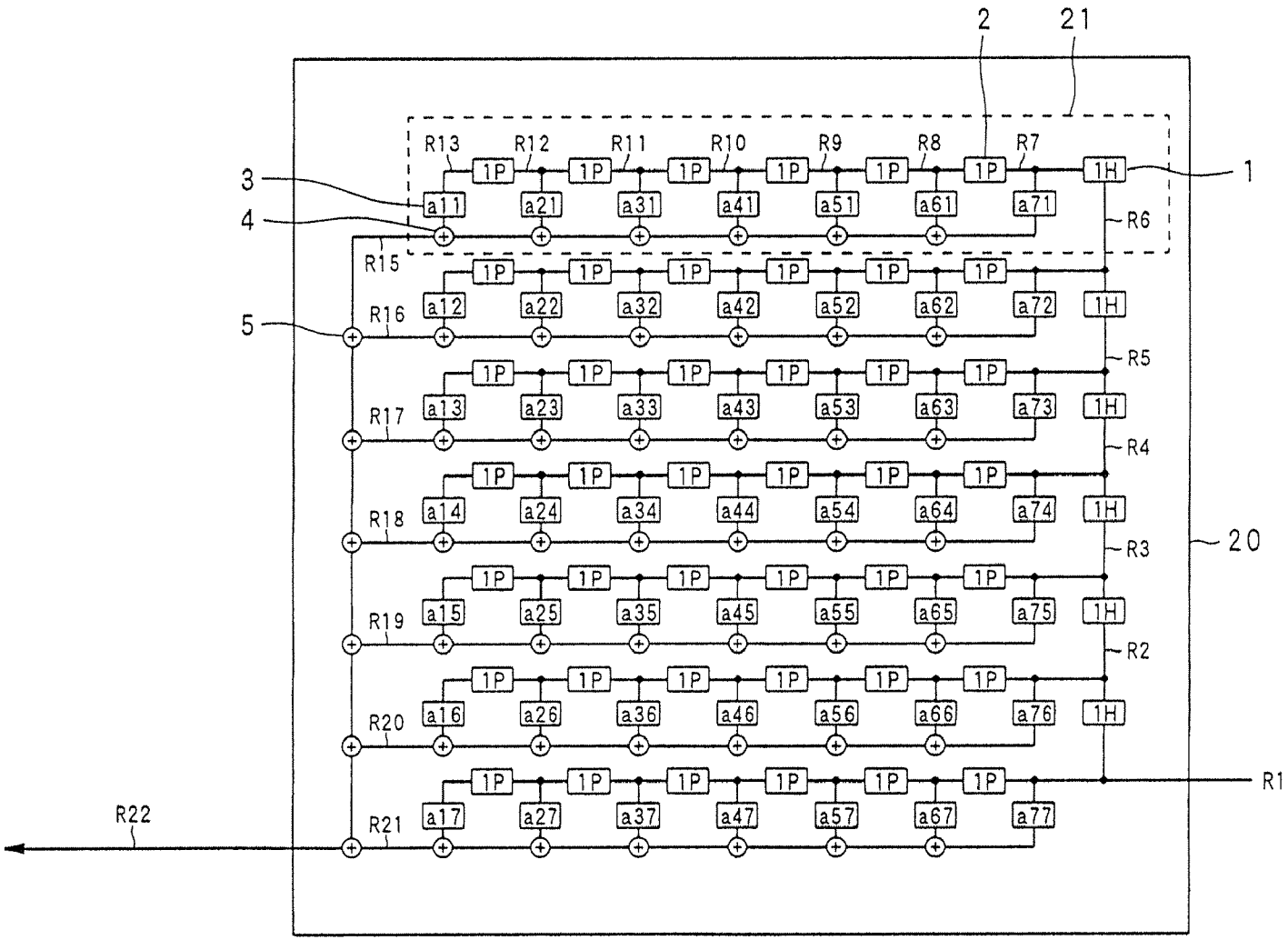
FIG. 10 is a detailed view of a neighborhood data integration section.

The neighborhood data integration sections 20RR, 20GR, and 20BR are equal in configuration to that shown in FIG. 2. The neighborhood data integration sections 20RG, 20RB, 20GG, 20GB, 20BG, and 20BB differ from that shown in FIG. 2 only in that they do not output pixel-of-interest data, and are constituted as shown in FIG. 10. The neighborhood data integration sections 20RR to 20BB calculate integrated values of data on pixels for which reflected electrons irradiated to the pixel of interest without the spacer are generated, and for which the reflected electrons are shielded by the spacer, similarly to the third embodiment.

The RGB addition sections 6R, 6G, and 6B integrate pieces of the pixel data for which the reflected electrons are irradiated to the pixel of interest for the colors R, G, and B, respectively. Similarly to the first to the third embodiments, each of the RGB addition sections 6R, 6G, and 6R adds up the R, G, and B data. The coefficient operation sections 7R, 7G, and 7B multiply input data WR22, WG22, and WB22 by the coefficient k related to the halation intensity, and output data R23, G23, and B23, respectively. The coefficient operation sections 7R, 7G, and 7B are basically equal in configuration to that according to the third embodiment.

Figure 11A:
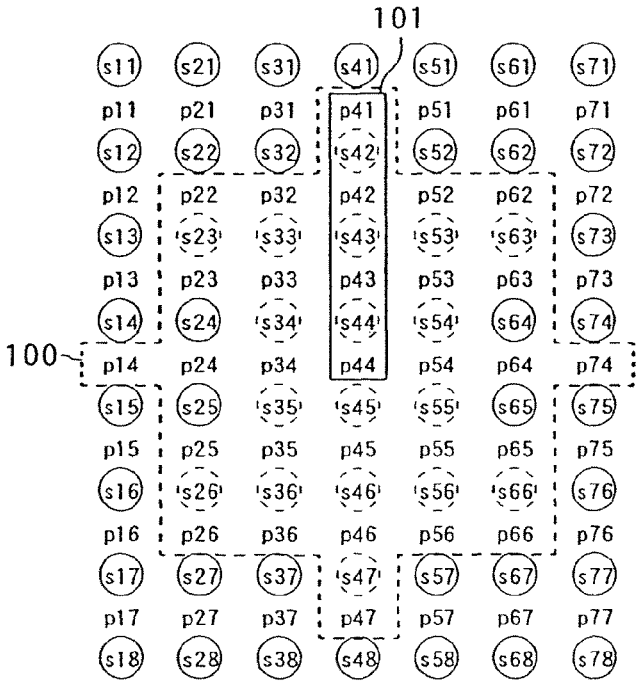
FIG. 11 A shows arrangement of pixels and a spacer around a pixel of interest.
FIG. 11B shows arrangement of the pixels and the spacers when the spacer is located at s42.

FIG. 11A shows a positional relationship among the pixels p1 to p77 and the spacer 4012 at locations s11 to s78. Actually, the spacer 4012 is present either at any one of the locations s11 to s78 or at a location other than s11 to s78. Pixels within a dotted line 100 are pixels for which reflected electrons are to be irradiated to the pixel of interest p44 if no spacer is present.

Figure 11B:
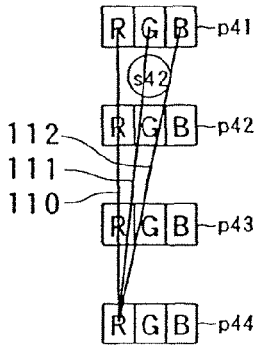

FIG. 11B shows the extracted pixels surrounded by a solid line 101 shown in FIG. 11A. Each pixel is composed by three phosphors of colors R, G, and B (herein after, "R, G, and B phosphors"), and the three R, G, and B phosphors are arranged from left in this order. Electrons emitted from three electron emitting devices corresponding to the three phosphors are irradiated to the respective three phosphors. Namely, the electron emitting devices are arranged in a matrix so as to correspond to the respective phosphors.

Referring to FIG. 11A, processings performed when the spacer 4012 is present at the location s11 will be described. In this case, the reflected electrons generated by the irradiation of electrons from the electron emitting devices corresponding to the neighborhood pixels, and irradiated to the pixel of interest p44 are not shielded by the spacer 4012. Therefore, no luminance irregularity and no color irregularity occur due to the presence of the spacer 4012.

The coefficients a11 to a77 used in the neighborhood data integration section 20RR shown in FIG. 9 will first be described. The neighborhood data integration section 20RR calculates an integrated value of R data on pixels for which the reflected electrons to be irradiated to the R phosphor in the pixel of interest p44 are shielded by the spacer 4012. For example, the reflected electrons generated by irradiation of electrons occur to the R phosphor in a certain pixel p (which reflected electrons will be referred to as "reflected electrons generated in the R phosphor in the pixel p" herein after). If the irradiation of the reflected electrons to the R phosphor in the pixel of interest p44 is shielded by the spacer 4012, the R data on the pixel p is integrated by the neighborhood data integration section 20RR.

In this embodiment, similarly to the third embodiment, each neighborhood data integration section calculates the integrated value of data on pixels for which the reflected electrons to be irradiated to the pixel of interest p44 are shielded by the spacer 4012. If the spacer 4012 is present at the location s11, no such pixel is present. Therefore, the coefficients a11 to a77 used in the neighborhood data integration section 20RR are all set at zero.

The coefficients a11 to a77 used in the neighborhood data integration section 20GR will next be described. The neighborhood data integration section 20GR calculates an integrated value of G data on pixels for which the reflected electrons to be irradiated to the R phosphor in the pixel of interest p44 are shielded by the spacer 4012. For example, the reflected electrons are generated in the G phosphor in the certain pixel p. If the irradiation of the reflected electrons to the R phosphor in the pixel of interest p44 is shielded by the spacer 4012, the G data on the pixel p is integrated by the neighborhood data integration section 20GR.

In this embodiment, similarly to the third embodiment, each neighborhood data integration section calculates the integrated value of data on pixels for which the reflected electrons to be irradiated to the pixel of interest p44 are shielded by the spacer 4012. If the spacer 4012 is present at the location s11, no such pixel is present. Therefore, the coefficients a11 to a77 used in the neighborhood data integration section 20RR are all set at zero.

Likewise, the neighborhood data integration section 20BR calculates an integrated value of B data on pixels for which the reflected electrons to be irradiated to the R phosphor in the pixel of interest p44 are shielded by the spacer 4012. For example, the reflected electrons are generated in the B phosphor in the certain pixel p. If the irradiation of the reflected electrons to the R phosphor in the pixel of interest p44 is shielded by the spacer 4012, the B data on the pixel p is integrated by the neighborhood data integration section 20BR.

In this embodiment, similarly to the third embodiment, each neighborhood data integration section calculates the integrated value of data on pixels for which the reflected electrons to be irradiated to the pixel of interest p44 are shielded by the spacer 4012. If the spacer 4012 is present at the location s11, no such pixel is present. Therefore, the coefficients a11 to a77 used in the neighborhood data integration section 20BR are all set at zero.

Thus, output data RR22, GR22, and BR22 of the neighborhood data integration sections 20RR, 20GR, 20BR are all zero, and the output WR22 of the RGB addition section 6R that adds up these pieces of output data is also zero.

The coefficient operation sections 7R, 7G, and 7B according to this embodiment multiply the input data WR22, WG22, and WB22 by the coefficient k, and output the resultant data without inverting signs of the data, respectively. However, in the above-stated instance, the input data WR22 is zero, so that the output R23 of the coefficient operation section 7R is zero.

The adder 8 adds up the pixel-of-interest data R14 and the data R23. If the spacer 4012 is present at the location the s11, the data R23 is zero. Therefore, data R24 is equal to the data R14. As a result, data which is subjected to no correction is displayed.

The reflected electrons to be irradiated to the pixel of interest p44 are not shielded by the spacer 4012 if the spacer 4012 is not present at any one of the locations s42, s23, s33, s53, s63, s34, s44, s54, s35, s45, s55, s26, s36, s46, s56, s66, and s47 surrounded by the dotted line 100. Therefore, the coefficients a11 to a77 used in each of the neighborhood data integration sections 20RR to 20BB are all zero.

An instance in which the spacer 4012 is present at the location s42 will be described with reference to FIG. 11B. The reflected electrons generated in the R phosphor in the pixel p41 are irradiated to the R phosphor in the pixel of interest p44 while following an orbit 110. In this case, since the reflected electrons are not shielded by the spacer 4012, the coefficient a41 in the neighborhood data integration section 20RR is zero. Further, the reflected electrons generated in the R phosphors in the pixels other than the pixel p41 are not shielded by the spacer 4012. Accordingly, if the spacer 4012 is at the location s42, the coefficients a11 to a77 used in the neighborhood data integration section 20RR are all zero.

The reflected electrons generated in the G phosphor in the pixel p41 are irradiated to the R phosphor in the pixel of interest p44 if the spacer 4012 is not present at the location s42. However, if the spacer 4012 is present at the location s42, the reflected electrons are shielded by the spacer 4012 and not irradiated to the R phosphor in the pixel of interest p44. Accordingly, the coefficient a41 in the neighborhood data integration section 20GR is one. The reflected electrons generated in the G phosphors in the pixels other than the pixel p41 are not shielded by the spacer 4012. Therefore, all the coefficients except for the coefficient a41 are zero.

The reflected electrons generated in the B phosphor in the pixel p41 are irradiated to the R phosphor in the pixel of interest p44 if the spacer 4012 is not present at the location s42. However, if the spacer 4012 is present at the location s42, the reflected electrons are shielded by the spacer 4012 and not irradiated to the R phosphor in the pixel of interest p44. Accordingly, the coefficient a41 in the neighborhood data integration section 20BR is one. The reflected electrons generated in the B phosphors in the pixels other than the pixel p41 are not shielded by the spacer 4012. Therefore, all the coefficients except for the coefficient a41 are zero.

As can be seen, the neighborhood data integration section 20RR integrates R data on the neighborhood pixels of the pixel of interest p44 if the reflected electrons generated in the R phosphors in the neighborhood pixels are shielded by the spacer 4012 and not irradiated to the R phosphor in the pixel of interest p44. The neighborhood data integration section 20GR integrates G data on the neighborhood pixels of the pixel of interest p44 if the reflected electrons generated in the G phosphors in the neighborhood pixels are shielded by the spacer 4012 and not irradiated to the R phosphor in the pixel of interest p44. Further, the neighborhood data integration section 20BR integrates B data on the neighborhood pixels of the pixel of interest p44 if the reflected electrons generated in the B phosphors in the neighborhood pixels are shielded by the spacer 4012 and not irradiated to the R phosphor in the pixel of interest p44.

The coefficients a11 to a77 used in the neighborhood data integration section 20RR are set as shown in one of FIGS. 12A to 12V depending on the position of the spacer 4012. If the spacer 4012 is present at any one of the locations s42, s23, s33, s43, s53, s63, s34, s44, s54, s35, s45, s55, s26, s36, s46, s56, s66, and s47, the coefficients a11 to a77 are set as shown in one of FIGS. 11A to 11V. By so setting, a desired neighborhood data integrated value can be obtained.

For example, if the spacer 4012 is present at the location s44 in FIG. 11A, the reflected electrons generated in the R phosphors in the pixels p52, p62, and p53 are shielded by the spacer 4012, and not irradiated to the R phosphor in the pixel of interest p44. The reflected electrons generated in the R phosphors in the pixels other than the pixels p52, p62, and p53 are not shielded by the spacer 4012. Accordingly, the coefficients a52, a62, and a53 used in the neighborhood data integration section 20RR are one, and the other coefficients are zero, that is, the coefficients a11 to a77 are those shown in FIG. 12I. Thus, the output RR22 of the neighborhood data integration section 20RR is the integrated value of R data on the pixels p52, p62, and p53.

The adder 6R adds up the neighborhood data integrated values RR22, GR22, and BR22 thus obtained, and outputs the data WR22. The coefficient operation section 7R multiplies the data WR22 by the coefficient k, and outputs data R23. The data R23 is image data corresponding to the halation-causing light emission which is shielded by the spacer 4012 and which is not irradiated to the R phosphor in the pixel of interest p44. The adder 8 adds this data R23 to the pixel-of-interest data R14, and displays the resultant data.

Likewise, the neighborhood data integration sections 20RG, 20GG, and 20BG integrate R data, G data, and B data on the neighborhood pixels of the pixel of interest p44 if the reflected electrons generated in R, G, and B phosphors in the neighborhood pixels are shielded by the spacer 4012 and not irradiated to the G phosphor in the pixel of interest p44, respectively. In addition, the neighborhood data integration sections 20RB, 20GB, and 20BB integrate R data, G data, and B data on the neighborhood pixels of the pixel of interest p44 if the reflected electrons generated in R, G, and B phosphors in the neighborhood pixels are shielded by the spacer 4012 and not irradiated to the G phosphor in the pixel of interest p44, respectively.

The adder 6G adds up the neighborhood data integrated values RG22, GG22, and BG22 thus obtained, and outputs the data WG22. The coefficient operation section 7G multiplies the data WG22 by the coefficient k, and outputs data G23. The data G23 is image data corresponding to the halation-causing light emission which is shielded by the spacer 4012 and which is not irradiated to the G phosphor in the pixel of interest p44. The adder 9 adds this data G23 to the pixel-of-interest data G14, and displays the resultant data.

Furthermore, the adder 6B adds up the neighborhood data integrated values RB22, GB22, and BB22 obtained, and outputs the data WB22. The coefficient operation section 7B multiplies the data WB22 by the coefficient k, and outputs data B23. The data B23 is image data corresponding to the halation-causing light emission which is shielded by the spacer 4012 and which is not irradiated to the B phosphor in the pixel of interest p44. The adder 10 adds this data B23 to the pixel-of-interest data B14, and displays the resultant data.

By carrying out these processings, the reflected electrons shielded by the spacer 4012 can be applied to the pixel of interest p44 as the image data. As a result, the light is emitted similarly to the case in which no spacer is present, so that the luminance irregularity and the color irregularity due to the presence of the spacer can be avoided.

Fifth Embodiment

As a fifth embodiment of the present invention, an instance in which data corresponding to halation-causing light emission is subtracted from the pixel-of-interest data similarly to the first embodiment will be described. A circuit block diagram according to this embodiment is FIG. 9 similarly to the fourth embodiment.

Figure 13:
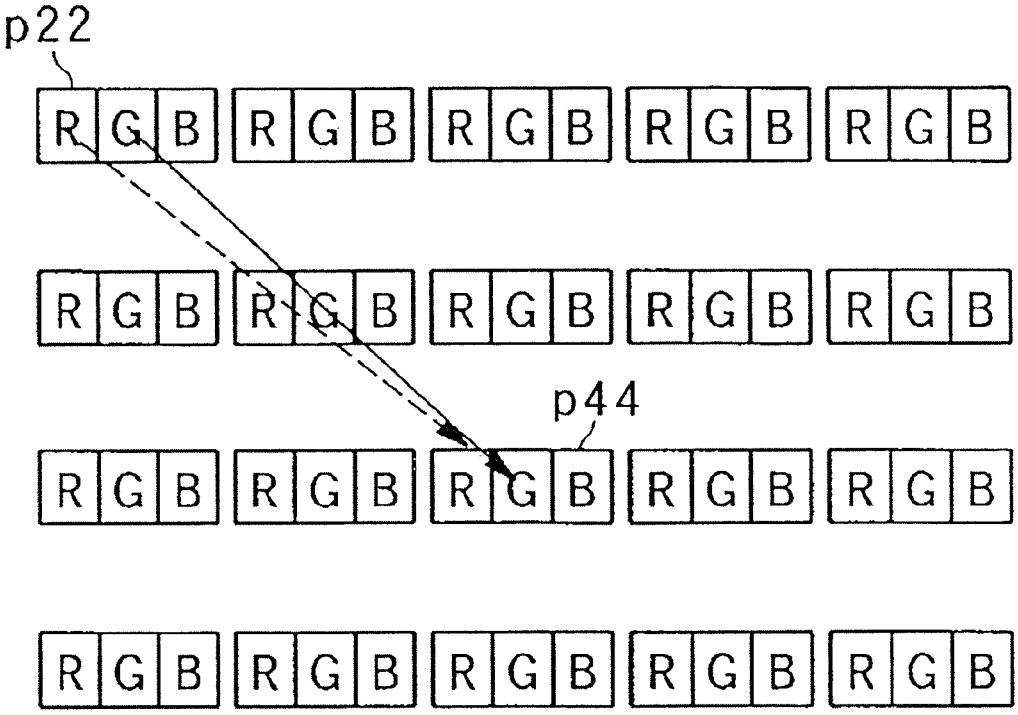
FIG. 13 is an explanatory view for a correction error according to the first embodiment.

FIG. 13 is an explanatory view for a correction error which occurs when the first embodiment is carried out.

The reflected electrons generated in the G phosphor in the pixel p22 are incident on the G phosphor in the pixel of interest p44, and induce halation-causing light emission (as indicated by an arrow of a solid line in FIG. 13). The reflected electrons generated in the R phosphor in the pixel p22 are not incident on the G phosphor in the pixel of interest p44 (as indicated by an arrow of a dotted line in FIG. 13) for the following reason. A distance between the R phosphor in the pixel p22 and the G phosphor in the pixel of interest p44 is larger than a distance between the G phosphor in the pixel p22 and the G phosphor in the pixel of interest p44. Due to this, the reflected electrons generated in the R phosphor in the pixel p22 do not reach the G phosphor in the pixel of interest p44.

According to the first embodiment, it is assumed as follows. Any pixel within the approximated halation region 61 shown in FIG. 4 induces the halation-causing light emission of all the R, G, and B phosphors in the pixel of interest p44 for all the colors of R, G, and B. Namely, it is assumed that the reflected electrons generated in whatever phosphors of R, G, and B in the pixel p22 induce the halation-causing light emission of the G phosphor in the pixel of interest p44. Actually, however, the reflected electrons generated in some of the R, G, and B phosphors in pixels (e.g., the pixel p22) on a boundary of the halation region 61 do not induce the halation-causing light emission. According to the first embodiment, the correction is carried out while ignoring this correction error.

The circuit block diagram according to this embodiment is FIG. 9 similarly to the fourth embodiment. As stated above, the pixels on the boundary of the halation region 61 include the color that induces the halation-causing light emission of the pixel of interest and the color that does not induces the halation-causing light emission thereof. According to this embodiment, therefore, if the correction value for the color G of the pixel of interest p44 is to be obtained, for example, then the three blocks, i.e., the block 20RG that integrates R data on the neighborhood pixels, the block 20GG that integrates G data on the neighborhood pixels, and the block 20BG that integrates B data on the neighborhood pixels are employed. The coefficients a11 to a77 used in these blocks are set such that those for the pixels that induce the halation-causing light emission of the pixel of interest p44 are one and that the other coefficients are zero. As already stated, the pixels on the boundary of the halation region 61 include the color that induces the halation-causing light emission of the pixel of interest and the color that does not induces the halation-causing light emission thereof. Due to this, the coefficients a11 to a77 used in the three blocks are not always equal.

If the correction value for the color R of the pixel of interest p44 is to be obtained, the block 20RR that integrates R data on the neighborhood pixels, the block 20GR that integrates G data on the neighborhood pixels, and the block 20BR that integrates B data on the neighborhood pixels are employed. Likewise, if the correction value for the color B of the pixel of interest p44 is to be obtained, the block 20RB, the block 20GB, and the block 20BB are employed.

According to the fourth embodiment, the data R14, G14, and B14 on the pixel of interest p44 are added to the correction values R23, G23, and B23, respectively. According to the fifth embodiment, the correction values R23, G23, and B23 are subtracted from the data R14, G14, and B14 on the pixel of interest p44, respectively. By so correcting, it is possible to correct the reduction in color saturation caused by the halation while reducing the correction error as seen in the first embodiment.

Sixth Embodiment

As a sixth embodiment of the present invention, an instance of subtracting the data corresponding to the halation-causing light emission from the pixel-of-interest data similarly to the first embodiment will be described. In this embodiment, an instance of using a media processor to perform a correction calculation will be described.

Figure 14:
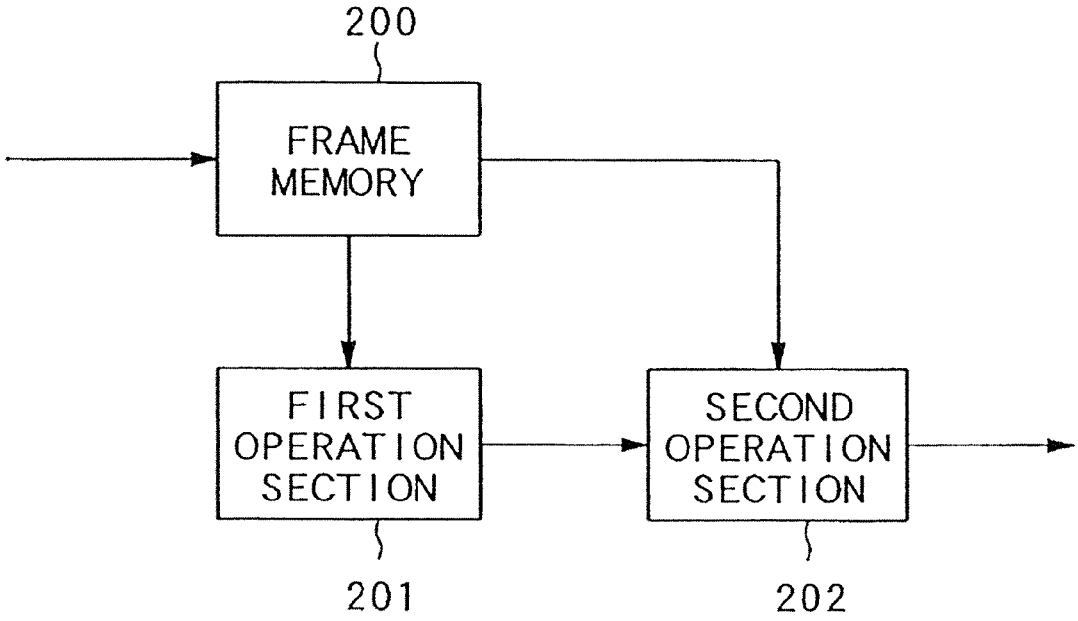
FIG. 14 is a block diagram according to a sixth embodiment.

FIG. 14 is a block diagram according to the sixth embodiment. In FIG. 14, reference symbol 200 denotes a frame memory, 201 denotes a first operation section, and 202 denotes a second operation section.

Input data for one frame is stored in the frame memory 200. The first operation section 201 performs a convolution of to-be-corrected data stored in the frame memory 200 using the coefficients a11 to a77 shown in FIG. 4B as kernels. Namely, the first operation section 201 reads data on 7×7 pixels about the pixel of interest p44 from the frame memory 200, multiplies the respective elements by the coefficients shown in FIG. 4B, and integrates multiplication results.

The second operation section 202 multiplies an output of the first operation section 201 by the coefficient k expressed by the Equation 4. The second operation section 202 then subtracts the multiplication result from the data on the pixel of interest p44 read from the frame memory 200, and outputs resultant data as correction data for display.

As can be seen, the correction processing can be carried out by the media processor or the like.

Seventh Embodiment

As a seventh embodiment of the present invention, an instance in which data corresponding to halation-causing light emission is subtracted from the pixel-of-interest data similarly to the first embodiment will be described. According to the first embodiment, the coefficients a11 to a77 each of which has the value 0 or 1 are used as shown in FIG. 4B. According to this embodiment, coefficients close to a luminance distribution of an actual halation are used.

FIG. 15 shows values of the coefficients a11 to a77 used in this embodiment. As shown in FIG. 15, some of the coefficients a11 to a77 have numeric values other than zero or one.

The correction method and the correction circuit according to this embodiment are completely equal to those according to the first embodiment except for the values of the coefficients a11 to a77. The values of the respective coefficients can be obtained by evaluating the influence of the emission of electrons from the proximate electron emitting devices on a light emitting region of interest by an experiment. As compared with the preceding embodiments in which the values of the coefficients are one of binary values of zero and one, more accurate correction can be carried out according to this embodiment.

According to the respective embodiments stated so far, the image display apparatus capable of obtaining a good light emitting state and the method for correcting the driving signals for the electron emitting devices employed to display an image can be realized.

What is claimed is:

1. An image display apparatus comprising:

a plurality of electron emitting devices;

a plurality of light emitting regions arranged to be distanced from the electron emitting devices, and emitting lights by being irradiated with electrons emitted from the electron emitting devices, the plurality of light emitting regions corresponding to the plurality of electron emitting devices respectively, the plurality of electron emitting devices including at least one first electron emitting device and at least one second electron emitting device;

an electron shield member which suppresses irradiation of electrons, resulting from electron-emission from the first electron emitting device, to a light emitting region corresponding to the second electron emitting device, wherein there is an increase in a quantity of emitted light of the light emitting region corresponding to the second electron emitting device, the increase resulting from electron-emission from electron emitting devices proximate to the second electron emitting device, changes according to a quantity of electrons, resulting from electron-emission from the proximate electron emitting devices, shielded by the electron shield member; and a driving circuit which outputs a driving signal for driving the electron emitting devices, wherein the driving circuit includes a correction circuit for correcting a signal, the correction circuit being a circuit which outputs a corrected signal for the second electron emitting device corresponding to the light emitting region having a first increase in a quantity of emitted light, the first increase resulting from the electrons emitted from electron emitting devices proximate to the second electron emitting device, wherein the first increase is smaller than an increase resulting from electron-emission from said proximate electron emitting devices not being suppressed by said electron shield member, so as to increase the quantity of the light of the light emitting region corresponding to the second electron emitting device, and the driving signal is generated based on the corrected signal.

2. An image display apparatus according to claim 1, wherein the driving circuit makes the correction using, as a correction value, a value obtained by an evaluation of the increase in the quantity of emitted light if the electrons are not shielded by the electron shield member.

3. An image display apparatus according to claim 2, wherein the driving circuit performs an operation for the evaluation based on input signals input to the driving circuit as signals corresponding to the proximate electron emitting devices.

4. An image display apparatus according to claim 1, wherein the driving circuit makes the correction based on a value obtained by multiplying a plurality of input signals input to a plurality of electron emitting devices by a coefficient for evaluating the increase in the quantity of emitted light of the light emitting region corresponding to the second electron emitting device corresponding to the corrected driving signal, the increase resulting from the electrons emitted from the proximate electron emitting devices if the electrons are not shielded by the electron shield member.

5. An image display apparatus comprising:

a plurality of electron emitting devices;

a plurality of light emitting regions arranged to be distanced from the electron emitting devices, and emitting lights by being irradiated with electrons emitted from the electron emitting devices, the plurality of light emitting regions corresponding to the plurality of electron emitting devices respectively;

an electron shield member which shields the electrons resulting from electron-emission from the electron emitting device corresponding to a predetermined light emitting region out of the plurality of light emitting regions, and which thereby suppresses irradiation of the electrons, resulting from electron-emission from the electron emitting devices corresponding to the predetermined light emitting region, to the light emitting regions other than the predetermined light emitting region; and a driving circuit which outputs a driving signal for driving the electron emitting devices, wherein the driving circuit includes a correction circuit for correcting a signal, the correction circuit being a circuit which makes a correction based on a value obtained by an evaluation of a quantity of the electrons shielded by the electron shield member, and the driving signal is generated based on the corrected signal.

6. An image display apparatus comprising:

a plurality of electron emitting devices;

a plurality of light emitting regions arranged to be distanced from the electron emitting devices, and emitting lights by being irradiated with electrons emitted from the electron emitting devices, the plurality of light emitting regions corresponding to the plurality of electron emitting devices respectively;

an electron shield member which shields the electrons emitted from the electron emitting device corresponding to a predetermined light emitting region out of the plurality of light emitting regions and reflected by the light emitting regions or a member near the light emitting regions, and which thereby suppresses irradiation of the reflected electrons to the light emitting regions other than the predetermined light emitting region; and a driving circuit which outputs a driving signal for driving the electron emitting devices, wherein the driving circuit includes a correction circuit for correcting a signal, the correction circuit being a circuit that reduces a visual irregularity caused by non-uniformity of an effect of electron shield by the electron shield member, and the driving signal is generated based on the corrected signal.

7. An image display apparatus according to claim 1, wherein the electron shield member is a spacer that maintains a distance between the electron emitting devices and the light emitting regions.

8. An image display apparatus according to claim 5, wherein a plurality of the light emitting regions include the light emitting regions having different luminous colors, and the electron emitting devices proximate to the predetermined electron emitting device include at least one or more electron emitting devices corresponding to the light emitting regions for the luminous colors different from the luminous color of the light emitting region corresponding to the predetermined electron emitting device.

9. An image display apparatus according to claim 5, wherein the electron shield member is a spacer that maintains a distance between the electron emitting devices and the light emitting regions.

10. An image display apparatus according to claim 6, wherein the electron shield member is a spacer that maintains a distance between the electron emitting devices and the light emitting regions.

11. An image display apparatus comprising:

a plurality of electron emitting devices;

a plurality of light emitting regions arranged to be distanced from the electron emitting devices, and emitting lights by being irradiated with electrons emitted from the electron emitting devices, the plurality of light emitting regions corresponding to the plurality of electron emitting devices respectively, the plurality of electron emitting devices including at least a first electron emitting device and a second electron emitting device;

an electron shield member which suppresses irradiation of electrons, resulting from electron-emission from the first electron emitting device, to a light emitting region corresponding to the second electron emitting device;

a driving circuit which outputs a driving signal for driving the electron emitting devices, wherein the driving circuit includes a correction circuit for correcting a signal, the correction circuit being a circuit which outputs a corrected signal for the second electron emitting device so as to increase a quantity of light of the light emitting region corresponding to the second electron emitting device, the corrected signal being obtained using an input signal for the first electron emitting device.

12. An image display apparatus comprising:

a plurality of electron emitting devices;

a plurality of light emitting regions arranged to be distanced from the electron emitting devices, and emitting lights by being irradiated with electrons emitted from the electron emitting devices, the plurality of light emitting regions corresponding to the plurality of electron emitting devices respectively, the plurality of electron emitting devices including at least a first electron emitting device and a second electron emitting device;

an electron shield member which suppresses irradiation of electrons, resulting from electron-emission from the first electron emitting device, to a light emitting region corresponding to the second electron emitting device; and a driving circuit which outputs a driving signal for driving the electron emitting devices, wherein the driving circuit includes a correction circuit for correcting a signal, the correction circuit being a circuit which outputs a corrected signal for the second electron emitting device so as to increase a quantity of emitted light of the light emitting region corresponding to the second electron emitting device in a case where the first electron emitting device emits electrons.

13. An image display apparatus according to claim 11, wherein the electron shield member is a spacer that maintains a distance between the electron emitting devices and the light emitting regions.

14. An image display apparatus according to claim 12, wherein the electron shield member is a spacer that maintains a distance between the electron emitting devices and the light emitting regions.

15. An image display apparatus according to claim 11, wherein the electron shield member is arranged such that effects of electron shield for the plurality of the electron emitting devices by the electron shield member are different.

16. An image display apparatus according to claim 12, wherein the electron shield member is arranged such that effects of electron shield for the plurality of the electron emitting devices by the electron shield member are different.

17. An image display apparatus comprising:

a plurality of electron emitting devices including at least a first electron emitting device;

a plurality of light emitting regions emitting lights by being irradiated with electrons emitted from the plurality of electron emitting devices, said plurality of light emitting regions including at least a first light emitting region corresponding to the first electron emitting device;

a correction circuit that corrects a signal for driving the electron emitting devices;

wherein said correction circuit outputs, when an increase in a quantity of emitted light of the first light emitting region is caused by electrons emitted by electron emitting devices proximate to the first electron emitting device, as a signal obtained by correcting an input signal for the first electron emitting device, a signal corrected to be smaller than a signal to be output when there is no increase in a quantity of emitted light of the first light emitting region caused by electrons emitted by the proximate electron emitting devices.

18. An image display apparatus according to claim 17, wherein colors are configured in the light emitting regions, and reduction of color saturation is suppressed by correction of said correction circuit.

* * * * *